US011562668B2

(12) United States Patent
Toltzman et al.

(10) Patent No.: US 11,562,668 B2
(45) Date of Patent: Jan. 24, 2023

(54) SYSTEMS AND METHODS FOR A MODULAR SIGNAGE SYSTEM

(71) Applicant: BECON POST LLC, Scottsdale, AZ (US)

(72) Inventors: Randall Toltzman, Scottsdale, AZ (US); Chris Buttenob, Scottsdale, AZ (US); William Bingman, Scottsdale, AZ (US); Justin Salamon, Scottsdale, AZ (US); Scott Jarson, Scottsdale, AZ (US); Debbie Jarson, Scottsdale, AZ (US); Scott Smith, Scottsdale, AZ (US)

(73) Assignee: Becon Post LLC, Scottsdale, AZ (US)

( * ) Notice: Subject to any disclaimer, the term of this patent is extended or adjusted under 35 U.S.C. 154(b) by 24 days.

(21) Appl. No.: 17/219,125

(22) Filed: Mar. 31, 2021

(65) Prior Publication Data

US 2021/0304640 A1 Sep. 30, 2021

Related U.S. Application Data

(60) Provisional application No. 63/002,946, filed on Mar. 31, 2020.

(51) Int. Cl.
*G09F 7/18* (2006.01)
*E04H 12/22* (2006.01)

(52) U.S. Cl.
CPC ..... *G09F 7/18* (2013.01); *E04H 12/2215* (2013.01); *E04H 12/2253* (2013.01); *G09F 2007/1821* (2013.01); *G09F 2007/1873* (2013.01)

(58) Field of Classification Search
CPC ..... G09F 7/18; G09F 2007/1821; G09F 2007/1873; G09F 15/0037; G09F 15/0056; E04H 12/2215; E04H 12/2253; E04H 12/2292
See application file for complete search history.

(56) References Cited

U.S. PATENT DOCUMENTS 1,374,471 A * 4/1921 Name not available ..... G08G 1/096716 40/607.1
3,641,950 A * 2/1972 Axhamre ..... A47F 5/02 108/189
3,684,228 A * 8/1972 Sobel ..... A47F 5/14 248/224.8
4,134,564 A * 1/1979 Hanna ..... G09F 15/0006 403/255
4,279,104 A * 7/1981 Classen ..... E01F 9/685 52/165
4,334,374 A 6/1982 Spamer et al.
(Continued)

FOREIGN PATENT DOCUMENTS

DE 202018102488 U1 * 3/2019

OTHER PUBLICATIONS

International Search Report and Written Opinion issued in corresponding Application No. PCT/US2021/025164 dated Jul. 8, 2021, 11 pages.

*Primary Examiner* — Cassandra Davis
(74) *Attorney, Agent, or Firm* — Polsinelli PC

(57) ABSTRACT

Various embodiments of a modular signage system having a modular post that enables placement and display of a plurality of signs. The modular post includes a tab chamber that engages one or more signs and is configured to engage a stake for embedding within a ground surface.

24 Claims, 29 Drawing Sheets

(56) References Cited

U.S. PATENT DOCUMENTS

| | | | | | |
|---|---|---|---|---|---|
| 5,004,198 | A | * | 4/1991 | Jager | A47F 5/106 248/224.8 |
| 5,351,740 | A | * | 10/1994 | Hanna | G09F 7/18 52/775 |
| 5,722,205 | A | * | 3/1998 | Gannaway | E04H 12/2215 52/153 |
| D483,203 | S | * | 12/2003 | Dennig | D6/680.2 |
| 9,464,397 | B1 | | 10/2016 | Abraham | |
| 11,158,218 | B2 | * | 10/2021 | Margison | G09F 19/08 |
| 2006/0080876 | A1 | | 4/2006 | Carter | |
| 2008/0307684 | A1 | | 12/2008 | Ulloa et al. | |
| 2011/0036026 | A1 | | 2/2011 | Lee | |

* cited by examiner

SYSTEMS AND METHODS FOR A MODULAR SIGNAGE SYSTEM

CROSS REFERENCE TO RELATED APPLICATIONS

This is a non-provisional application that claims benefit to U.S. Provisional Patent Application Ser. No. 63/002,946 filed on Mar. 31, 2020, which is herein incorporated by reference in its entirety.

FIELD

The present disclosure generally relates to signage systems; and in particular, to a modular signage system that is configurable for different applications and uses.

BACKGROUND

The purpose of real-estate and event markers is to present information to a potential attendee or customer in a manner that is striking without being distracting and with clear visuals displaying pertinent information. However, typical real-estate and event markers come in fixed or limited configurations and can also be cumbersome to transport, assemble, and install. In addition, organizations such as schools or event venues that wish to promote products or provide directions or general information in a modular and easy-to-read format often have to create their own content or purchase new signs for specific applications.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
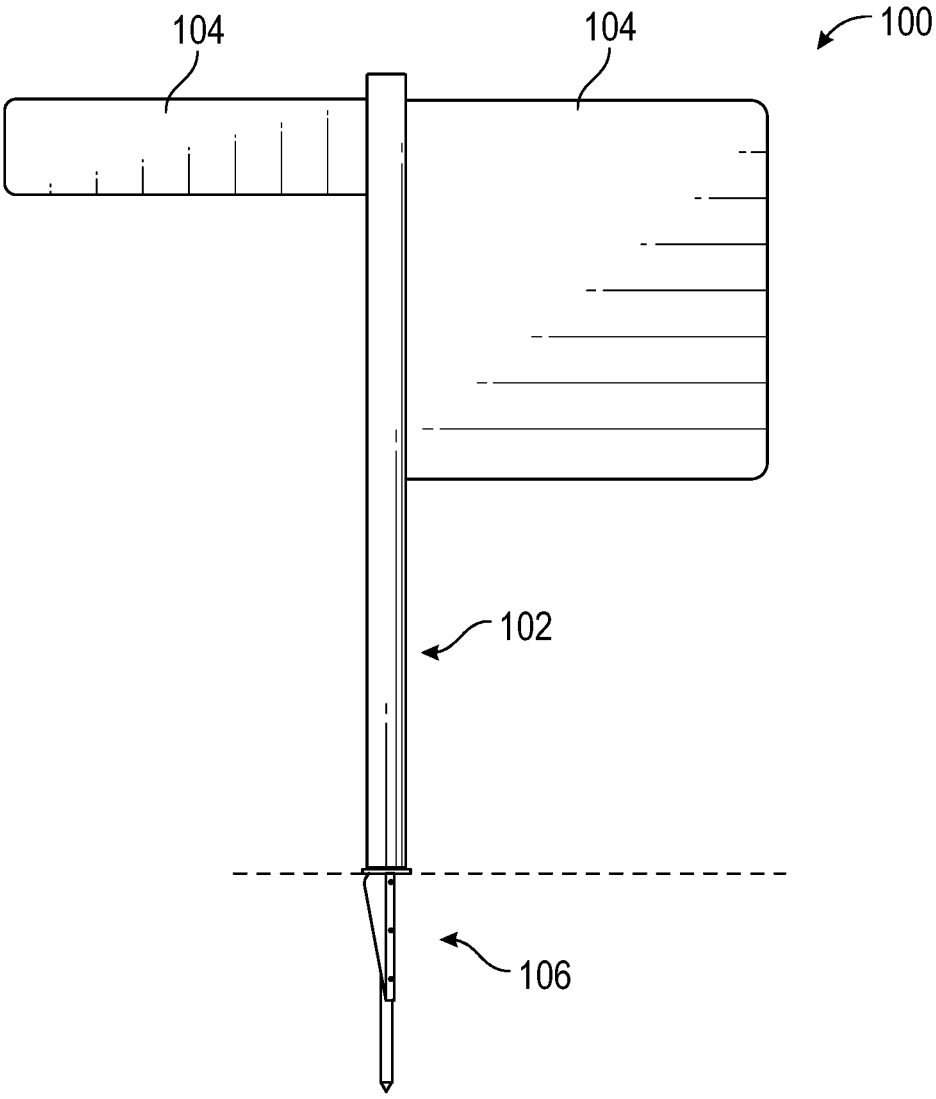
FIG. 1 is a front view showing one embodiment of a modular signage system.

Various embodiments of a modular signage system for providing a configurable sign arrangement system tailored to a particular application or purpose are disclosed herein. In some embodiments, the modular signage system includes a post defining at least one external slot being configured for engagement with a respective sign along one or more orientations. In some embodiments, a tab chamber including a plurality of tab apertures is disposed within the post for engaging one or more signs to the post. In one embodiment, at least one tab is formed along a tabbed portion of each sign with each tab configured for respective engagement with a respective tab aperture defined along the tab chamber. In another embodiment, the post includes a stake receptacle for receipt of a stake for securing the post to the ground. In one method of assembly of the modular signage system, one or more signs may be installed along the post of the modular signage system by insertion of each tab of a sign into a respective external slot of the post. In one aspect, the configurable and modular nature of the modular signage system allows tailoring to particular applications and preferences. Referring to the drawings, embodiments of a modular signage system are illustrated and generally indicated as 100 in FIGS. 1-26C.

Figure 2:
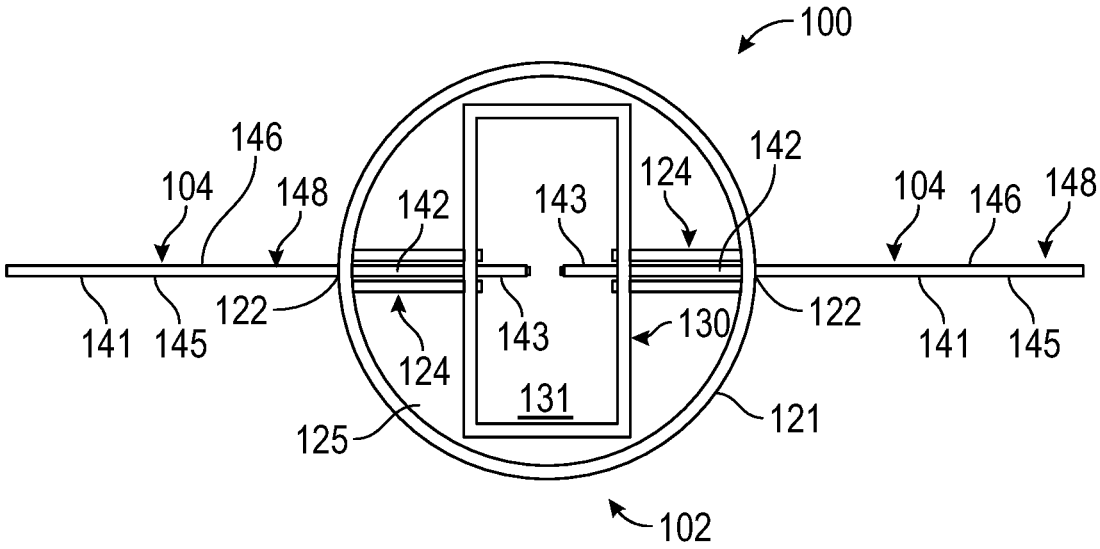
FIG. 2 is a top view showing the modular signage system of FIG. 1.
Figure 3:
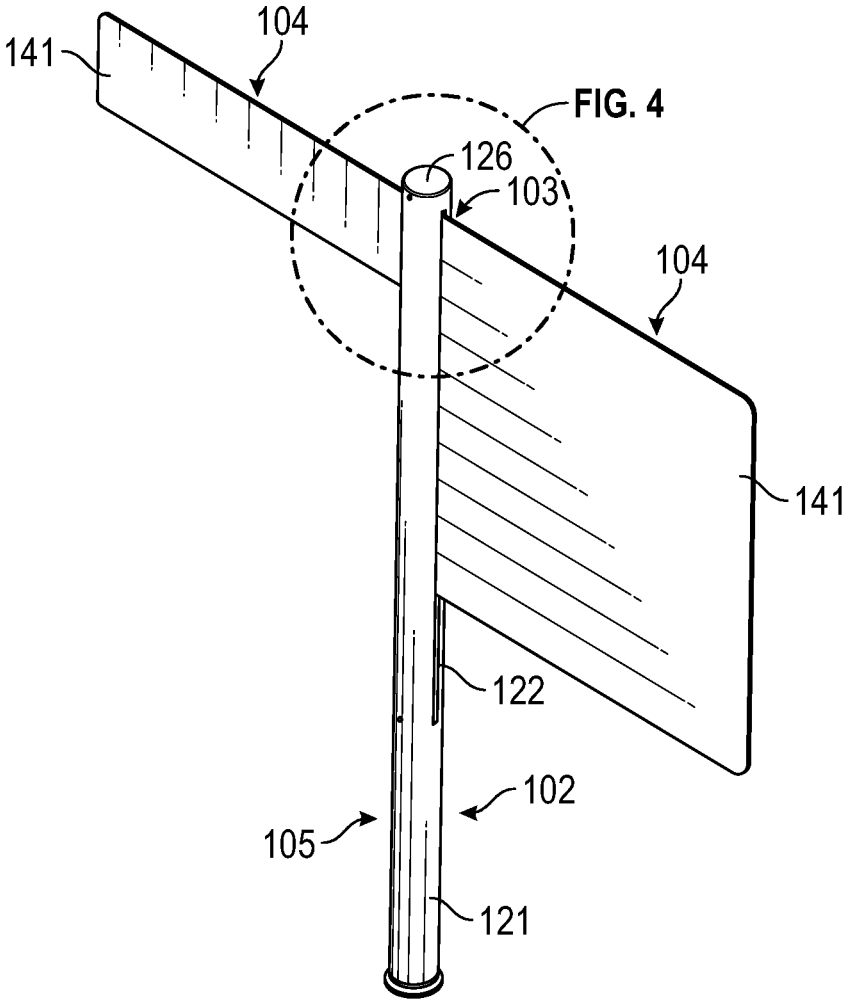
FIG. 3 is a perspective view showing the modular signage system of FIG. 1.
Figure 4:
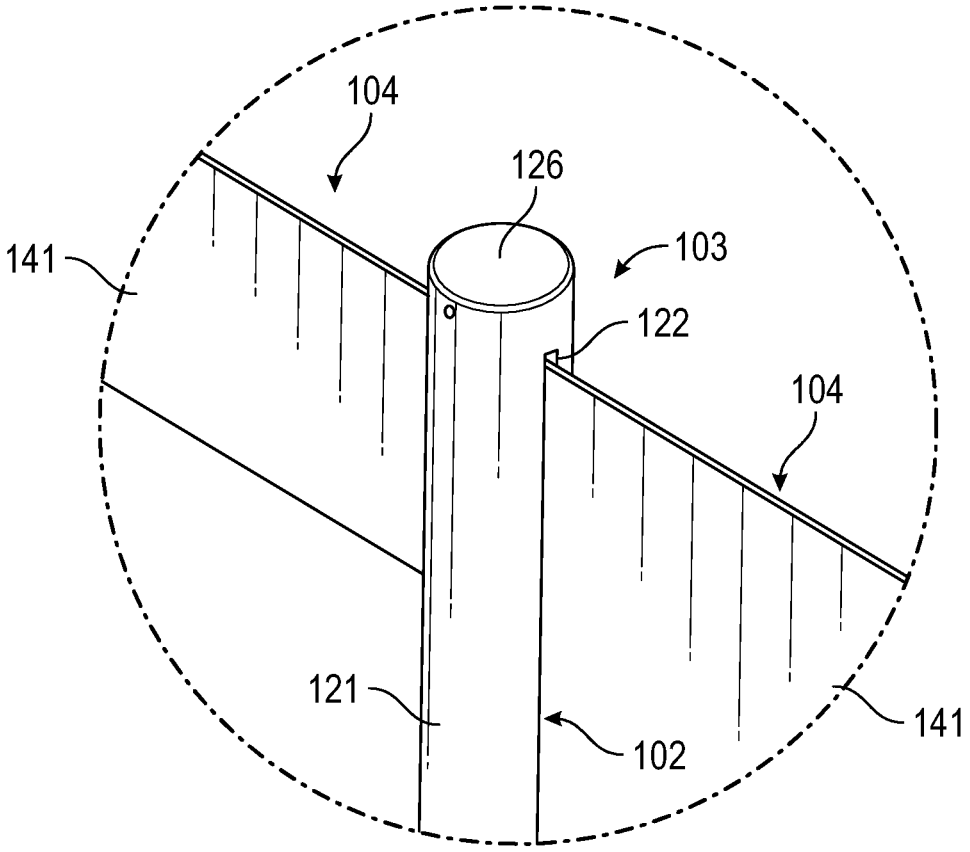
FIG. 4 is an enlarged view showing a top of the modular signage system of FIG. 1.

Referring to FIGS. 1-5, one embodiment of the modular signage system 100 is illustrated defining a post 102 with at least one sign 104 removably coupled to the post 102. The post 102 defines a superior portion 103 (FIG. 7) for engagement with the at least one sign 104 and an opposite inferior portion 105 (FIG. 7), the inferior portion 105 being configured to couple with a stake 106 for mounting the modular signage system 100 into the ground. Referring to FIG. 3, the superior portion 103 of the post 102 defines a post cap 126 that seals the top of the post 102. In some embodiments, the post cap 126 is removable to allow access to internal components of the post 102. In most embodiments, the sign 104 includes a generally planar body 141 having a tabbed portion 142 defined along a side of the body 141. The tabbed portion 142 includes at least one tab 143 for engagement with the post 102. The post 102 further defines an elongated body 121 having at least one external slot 122 running longitudinally along the elongated body 121. The external slot 122 communicates with a tab chamber 130 defined inside the post 102 for secure receipt of the tabbed portion 142 of the sign 104. During assembly, the tabbed portion 142 of the sign 104 is inserted through the external slot 122 and into the tab chamber 130 to engage within the post 102. In some embodiments, the post 102 includes two or more external slots 122 for engagement of two or more signs 104 of varying size and shape. For example, in the embodiment shown in FIGS. 1-5, two external slots 122 are defined along the elongated body 121 of the post 102 for receipt of a respective sign 104. FIGS. 24A-25E illustrate various example configurations of signs 104 that can be engaged with the post 102

Referring to FIGS. 1-7, cross-sectional views of an interior of the post 102 are provided. In particular, post 102 defines an internal cavity 125 within the elongated body 121. The post 102 includes a tab chamber 130 disposed within the internal cavity 125 for receipt of the tabbed portion 142 of at least one sign 104. Specifically, in some embodiments, the tab chamber 130 defines at least one tab row 136 defined longitudinally along the tab chamber 130. As shown the tab row 136 defines a plurality of tab apertures 137 for receipt of one or more tabs 143 of the sign 104 during assembly. In some embodiments, tab chamber 130 can include more than one tab row 136. For example, in the embodiment shown in FIGS. 1-7, tab chamber 130 defines two opposing tab rows 136 with each tab row 136 being associated with one of the two external slots 122 for respective receipt of one or more signs 104. Each tab aperture 137 of the tab row 136 is configured to align with the external slot 122.

Figure 6:
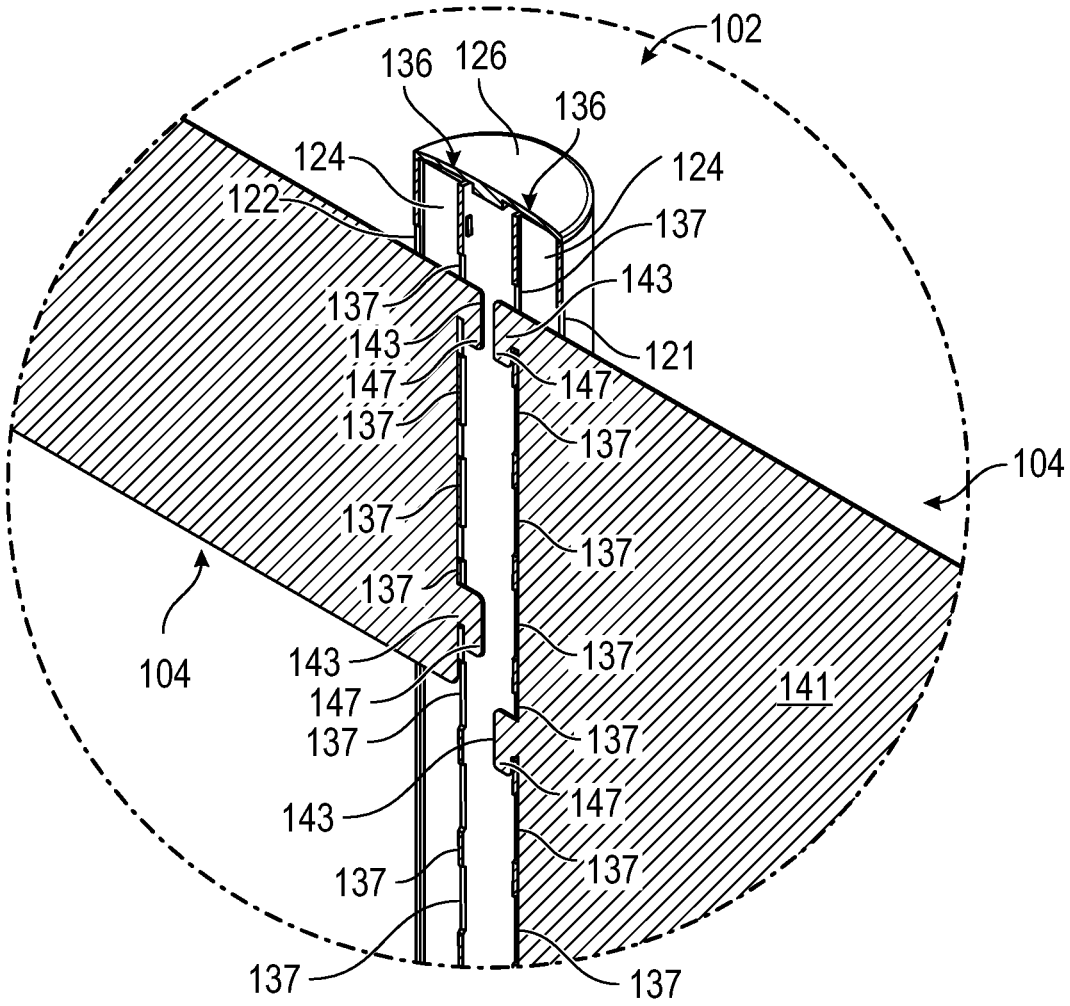
FIG. 6 is an enlarged cross sectional view showing the interior of the post of FIG. 5 in engagement with a sign.
Figure 7:
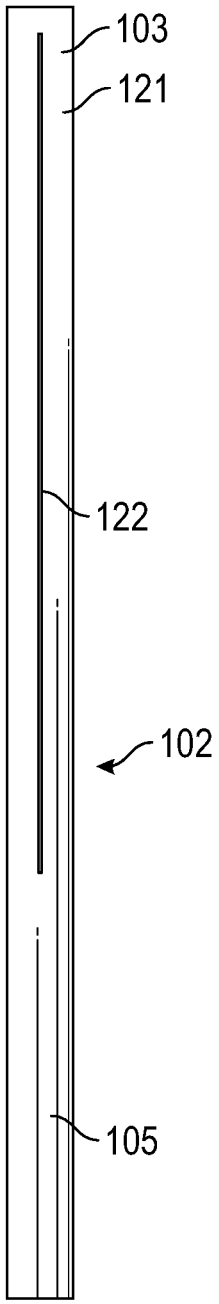
FIG. 7 is a side view showing the post of FIG. 5.
Figure 8:
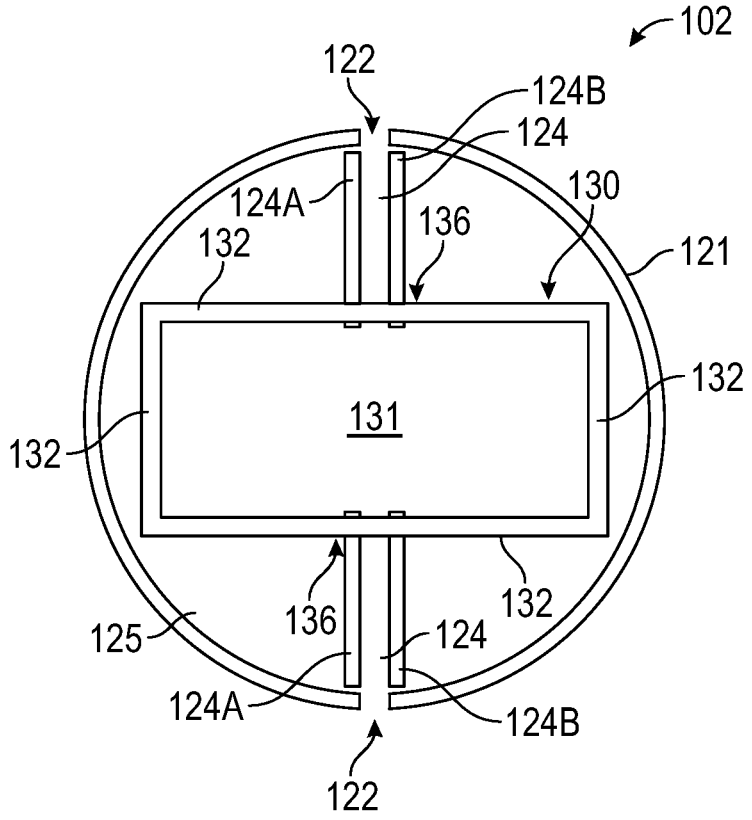
FIG. 8 is a top view showing a first embodiment of a tab chamber of the post of FIG. 5.
Figure 9:
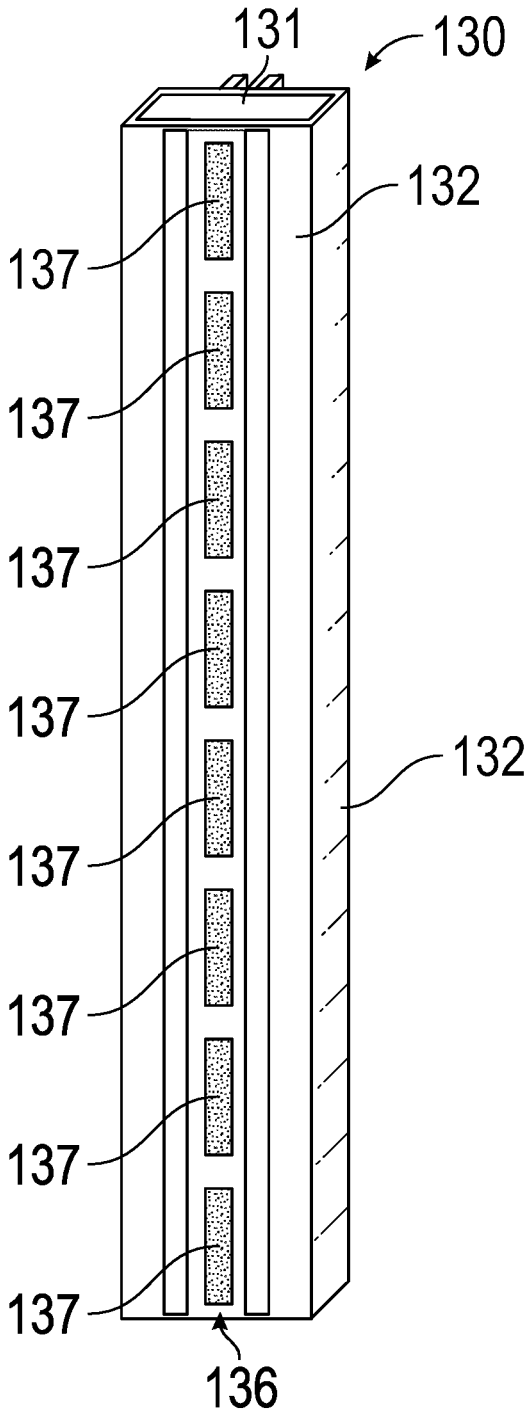
FIG. 9 is a perspective view showing the interior of the post of FIG. 5 with an outer surface of the post removed.

FIGS. 6, 8 and 9 illustrate a first embodiment of a tab chamber 130 for disposal within the elongated body 121 of the post 102. In some embodiments, tab chamber 130 defines a generally tubular shape with a cavity 131 defined longitudinally through the center of the tab chamber 130. Tab chamber 130 defines at least one wall 132. In particular, FIG. 8 shows the tab chamber 130 defining four walls 132 to form a rectangular cross-section. In the embodiment shown, two tab rows 136 each defining a respective plurality of tab apertures 137 formed longitudinally along two walls 132 of the four walls 132. As illustrated, the tab chamber 130 communicates with the at least one external slot 122 of the post 102 by a respective stabilizer slot 124 that guides each tab 143 of the sign 104 into engagement with a respective tab aperture 137 of the plurality of tab apertures 137. In some embodiments, stabilizer slot 124 defines a pair of parallel walls 124A and 124B that collectively form the stabilizer slot 124 which connects the external slot 122 with the wall 132 of the tab chamber 130.

Figure 10:
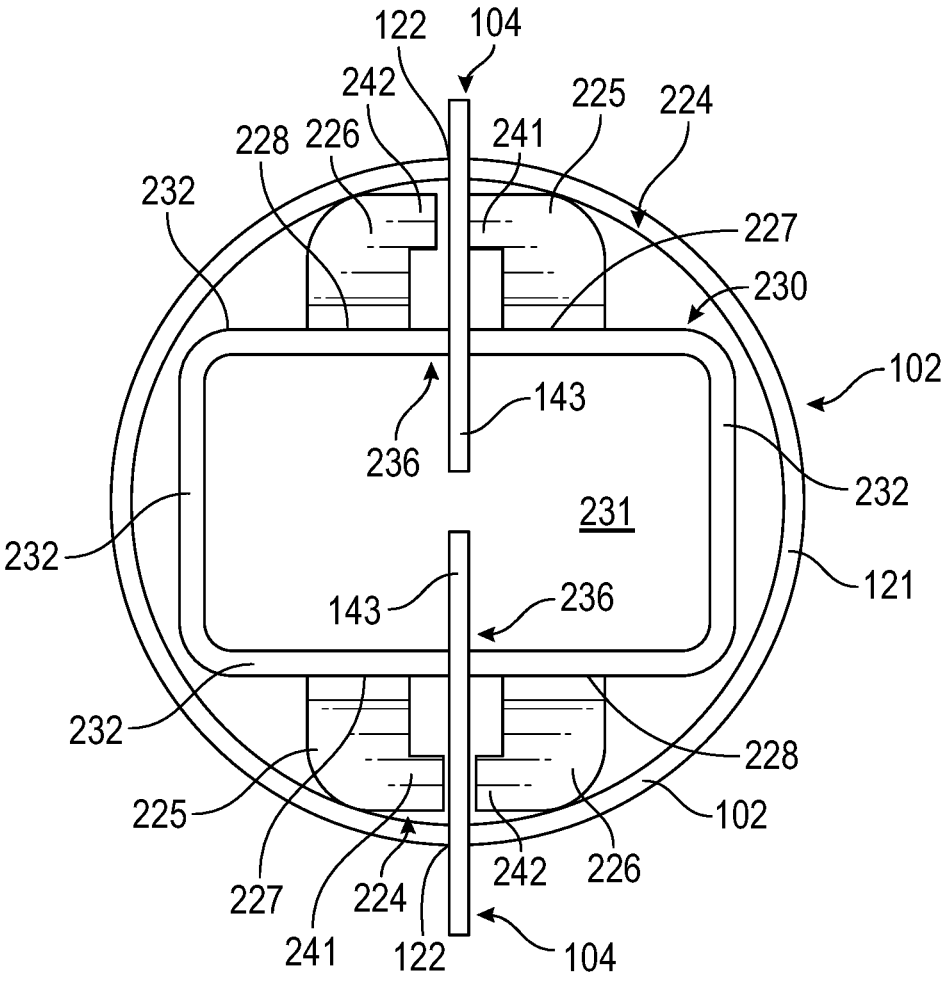
FIG. 10 is a top view showing a second embodiment of a tab chamber of the post of FIG. 5.
Figure 11:
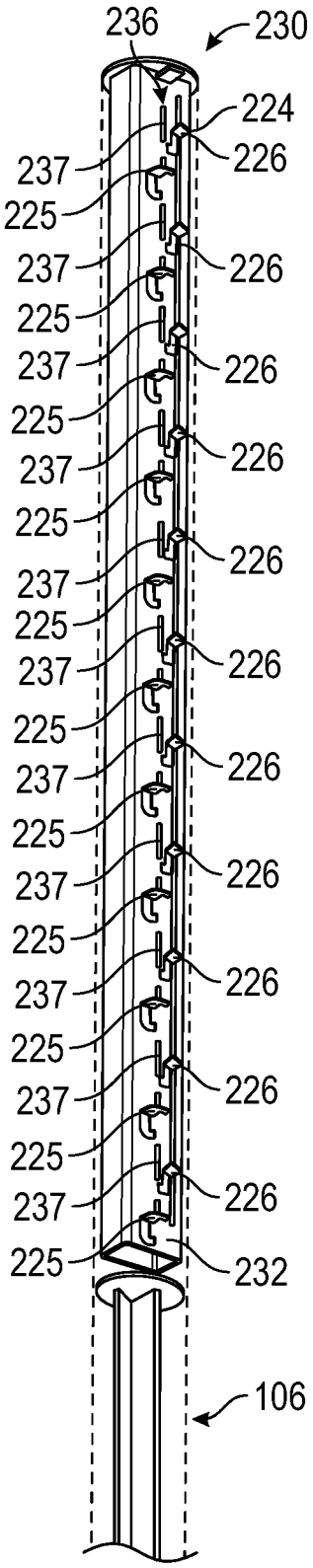
FIG. 11 is a perspective view showing the tab chamber of the post of FIG. 10 with an outer covering of the post removed.
Figure 12:
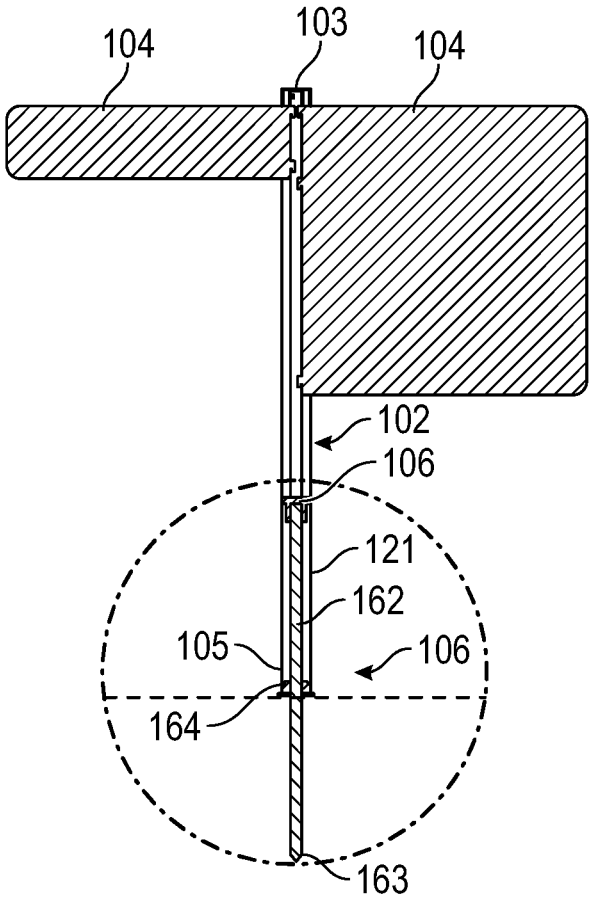
FIG. 12 is a front view showing a first embodiment of a stake disposed within the post of the modular signage system of FIG. 1.

FIGS. 10 and 11 illustrate a tab chamber 230, which is an alternate embodiment of the tab chamber 130. Similar to tab chamber 130, tab chamber 230 defines at least one wall 232 disposed within the post 102. Tab chamber 230 also defines a generally tubular body with a cavity 235 defined longitudinally through the center of the tab chamber 230. Similarly, tab chamber 230 also defines at least one wall 232. In particular, tab chamber 230 in FIGS. 10 and 11 defines four walls 232 to form a generally rectangular cross-section. In the embodiment shown, two tab rows 236, each defining a respective plurality of tab apertures 237, are defined longitudinally along two of the four walls 232. As illustrated, the tab chamber 230 communicates with at least one external slot 122 of the post 102 by a stabilizer slot 224 formed by a row of opposing stabilizer hooks 225 and 226 that guide each tab 143 of the sign 104 into a respective tab aperture 237 of the plurality of tab apertures 237.

As shown, in one embodiment, left stabilizer hooks 225 and opposing right stabilizer hooks 226 (directions referenced from the perspective of the associated external slot 122) collectively form stabilizer slot 224. The stabilizer hooks 225 and 226 each form a respective curved portion 241 and 242. Curved portion 241 of the left stabilizer hooks 225 points to the right towards the external slot 122 and curved portion 242 of the right stabilizer hooks 226 point to the left towards the external slot 122. Collectively, the curved portions 241 and 242 guide the tabs 143 of the one or more signs 104 into the cavity 235 of the tab chamber 230 and stabilize the tabbed portion 142 of the one or more signs 104 within the stabilizer slot 224.

In some embodiments, each stabilizer hook 225 and 226 of the row of stabilizer hooks 224 is formed by perforating a corresponding wall 232 of the tab chamber 230 in the shape of the stabilizer hook 225 or 226, with the exception of a respective non-perforated edge 227 or 228. The stabilizer hook 225 or 226, formed by material from the wall 232, is then bent along the non-perforated edge 227 or 228 and away from the wall 232, as shown in FIG. 11. In some embodiments, the stabilizer hook 227 or 228 is bent 90 degrees relative to the wall 232. In some embodiments, as shown in FIG. 10, the row of stabilizer hooks 224 is defined on either side of the tab row 236 with left and right stabilizer hooks 125 and 126 in an alternating fashion.

As discussed and as illustrated in FIGS. 1, 5 and 12-17, the inferior portion 105 of the post 105 includes a stake cavity 107 configured to receive the stake 106 for mounting of the modular signage system 100. The stake cavity 107 abuts the tab chamber 130 and terminates at the inferior portion 105 of the post 102. The stake 106 is disposed therein and includes the stake member 162 defining a superior portion 168 and an inferior portion 169. The superior portion 168 includes a cap 166 that abuts the tab chamber 130 when engaged with the post 102, and the inferior portion 169 defines a point 163 that secures or otherwise implants the post 102 into the ground. During installation of the post 102, the point 163 of the stake 106 is driven into the ground. Once the stake 106 is driven into the ground, the elongated body 121 of the post 102 can be installed on top of the stake 106.

Figure 15:
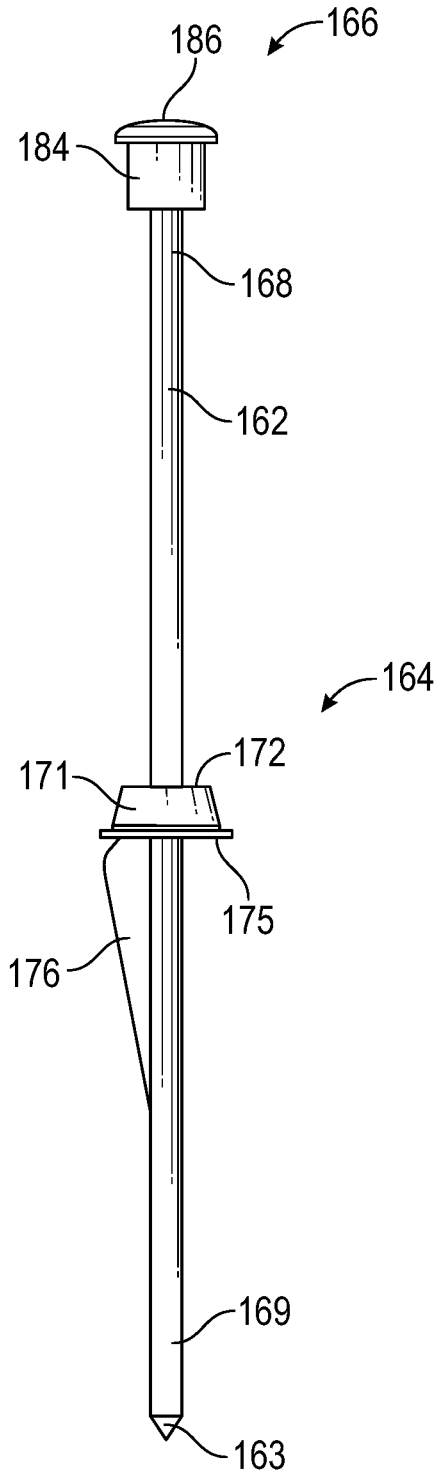
FIG. 15 is a side view showing the stake of FIG. 12 isolated from the post.
Figure 16:
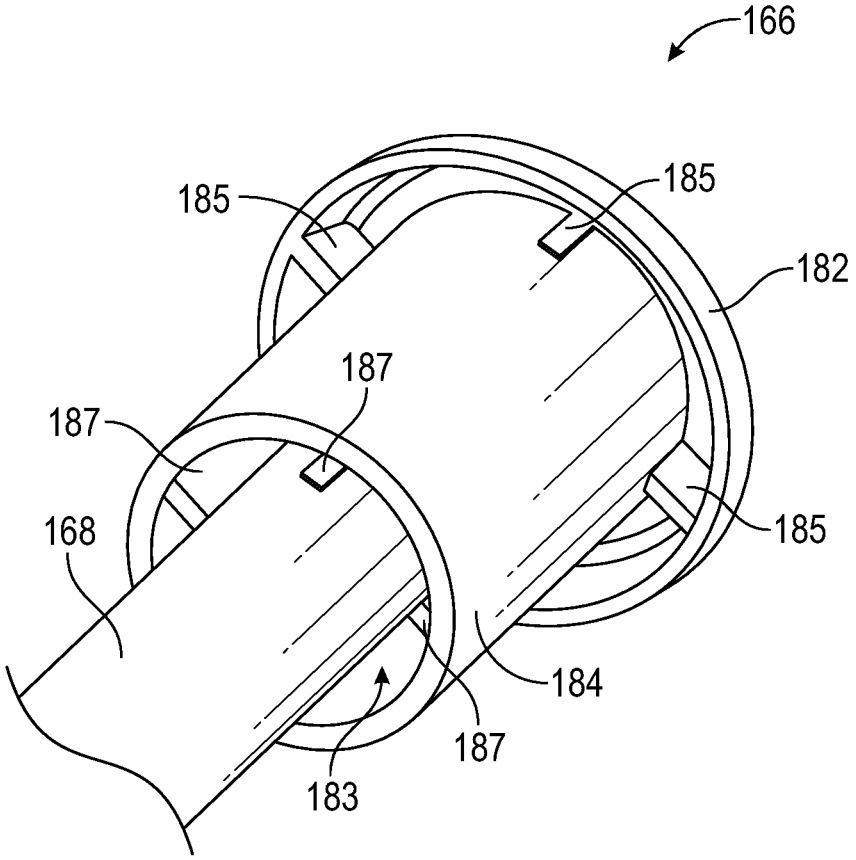
FIG. 16 is close-up bottom perspective view showing a cap of the stake of FIG. 12.
Figure 17:
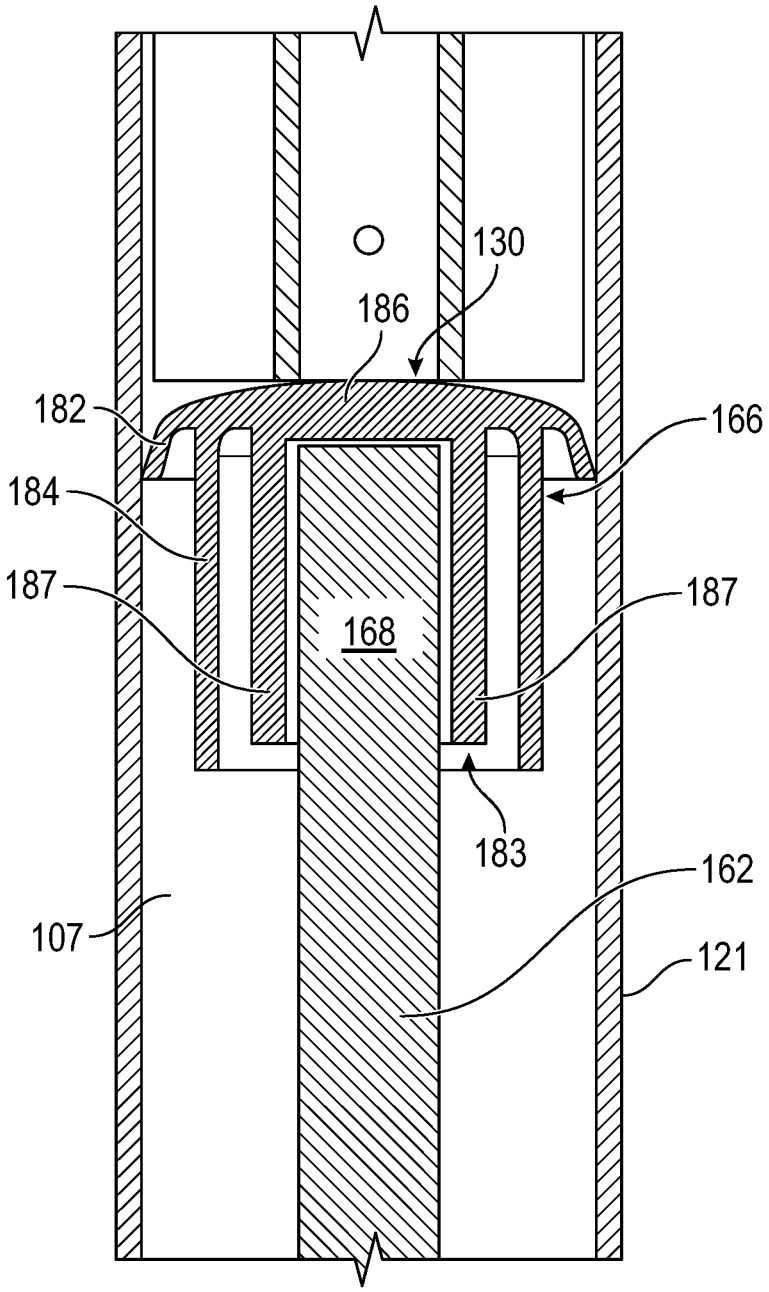
FIG. 17 is an enlarged cross-sectional side view showing the cap of FIG. 16.

Referring to FIGS. 15-17, the cap 166 is defined at the superior portion 168 of the stake 106 and provides a hammering surface for installation of the stake 106 into the ground and provides a stable resting surface for the tab chamber 130 when assembled. In particular, the cap 166 defines an upper surface 186 defining a circumferential flange 182 that contacts the interior surface of the elongated body 121. The cap 166 further defines a stem 184 that includes a stem cavity 183 for insertion of the superior portion 168 of the stake member 162. The circumferential flange 182 includes flange ribs 185 that provide additional stability between the circumferential flange 182 and the stem 184. Similarly, the stem 184 defines stem ribs 187 for stabilizing the superior portion 168 of the stake 106 within the stem 184.

Figure 13:
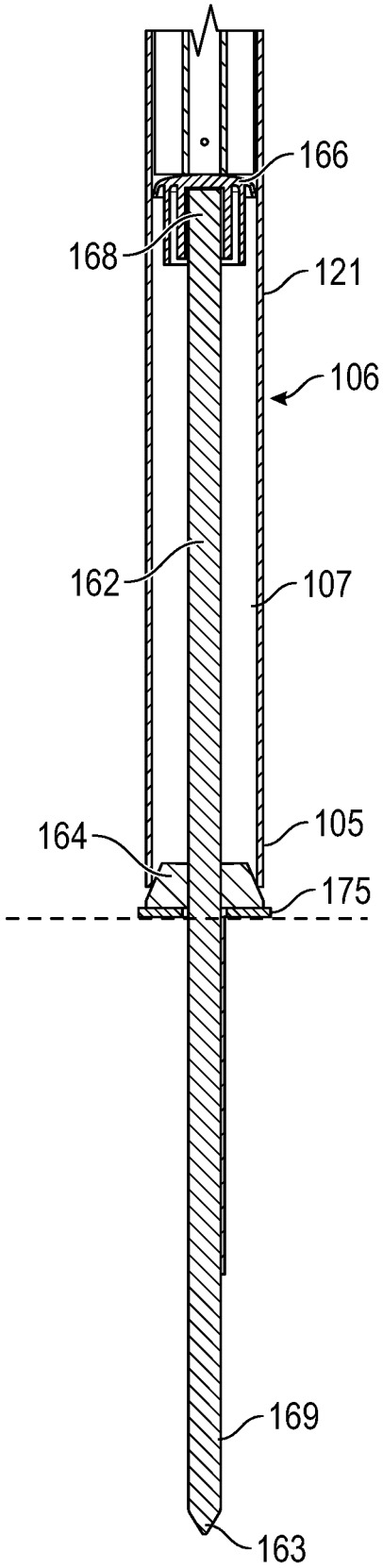
FIG. 13 is an enlarged view showing the stake of FIG. 12 disposed within the post.
Figure 14:
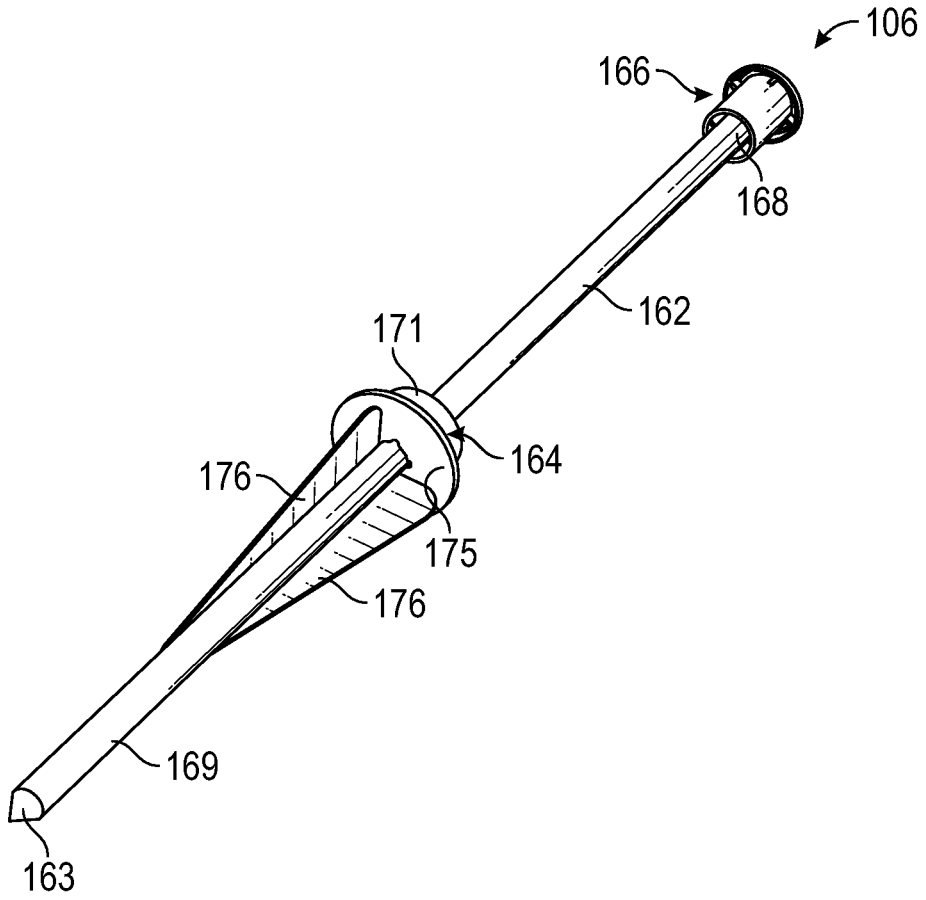
FIG. 14 is a bottom perspective view showing the stake of FIG. 12 isolated from the post.

Referring to FIGS. 13-15, the stake 106 further includes a stopper 164 positioned at a midsection along the stake member 162 such that the stopper 164 meets the inferior portion 105 of the post 104 for stability of the stake 106 relative to the post 102. The stopper 164 defines a peripheral edge 171 that contacts and seals the elongated body 121 of the post 102 around the stake member 162. The stopper 164 further defines a stability disc 175 located at the inferior portion 105 for contacting the ground during use and providing a pry surface to remove the stake 106 from the ground during disassembly. In some embodiments, the stake 106 further includes one or more stability wings 176 defined along the inferior portion 169 of the stake member 162 for stabilizing the stake 106 within the ground. In some embodiments, the stability wings 176 about the stability disc 175 and taper towards the point 163 of the stake member 163. In some embodiments, an alternative stopper (not shown) could alternatively be formed by one or more metal wings similar to stability wings 176, having a similar height and dimension as the stopper 164 and welded to the stake member 163.

Figure 18:
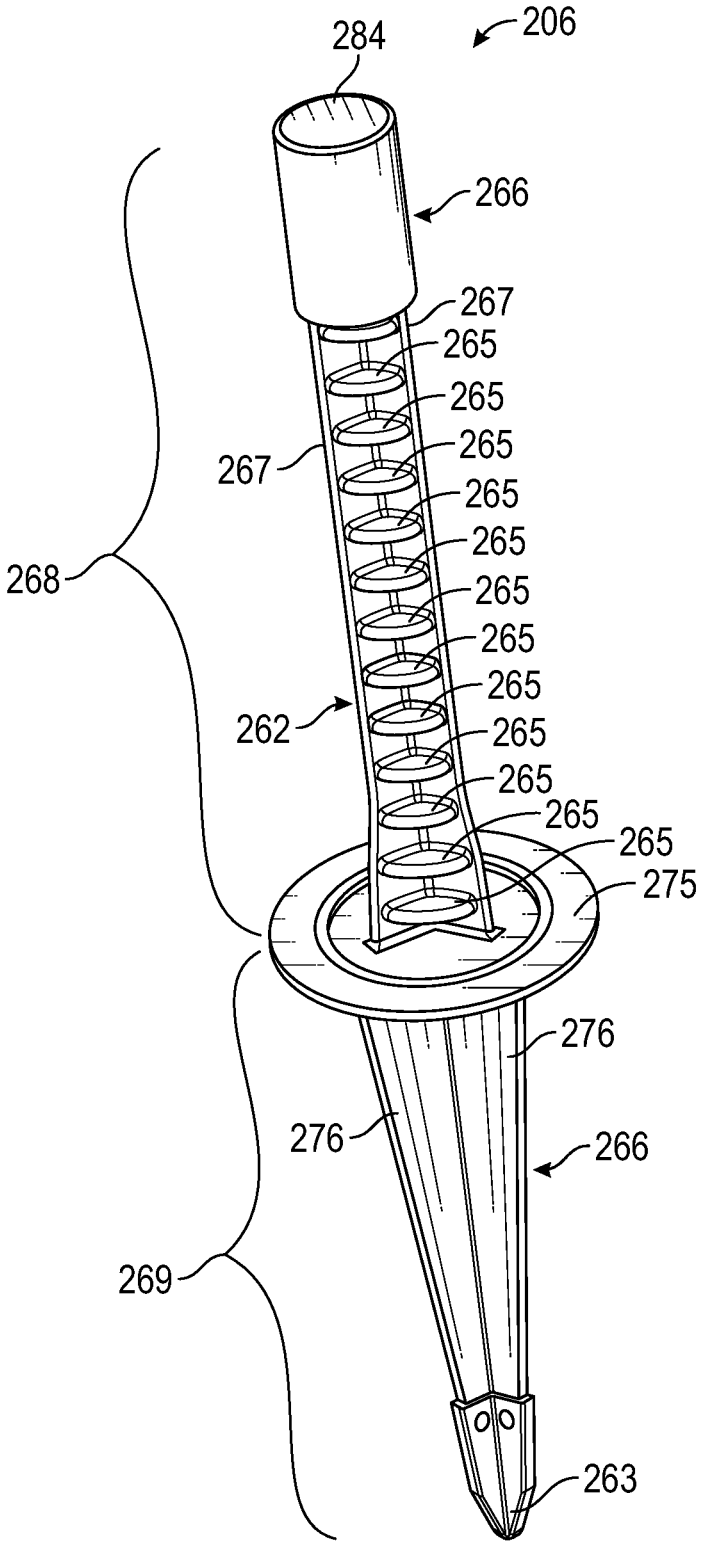
FIG. 18 is a perspective view showing a second embodiment of the stake of the modular signage system of FIG. 1.
Figure 19:
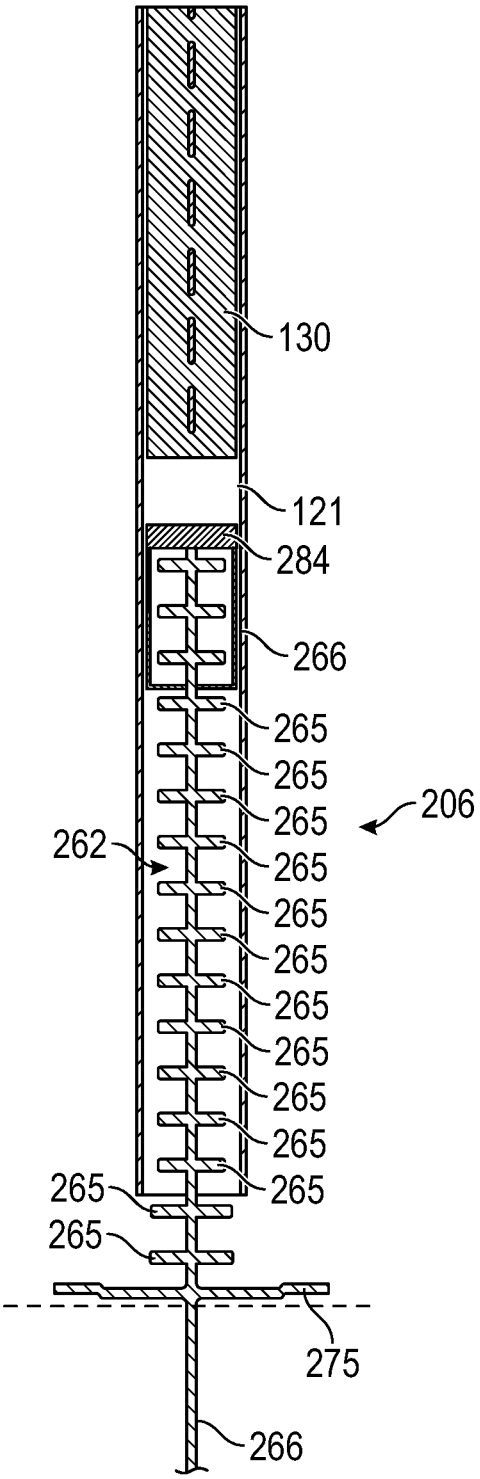
FIG. 19 is a side view showing the stake of FIG. 18 disposed within the post of the modular signage system of FIG. 1.
Figure 20:
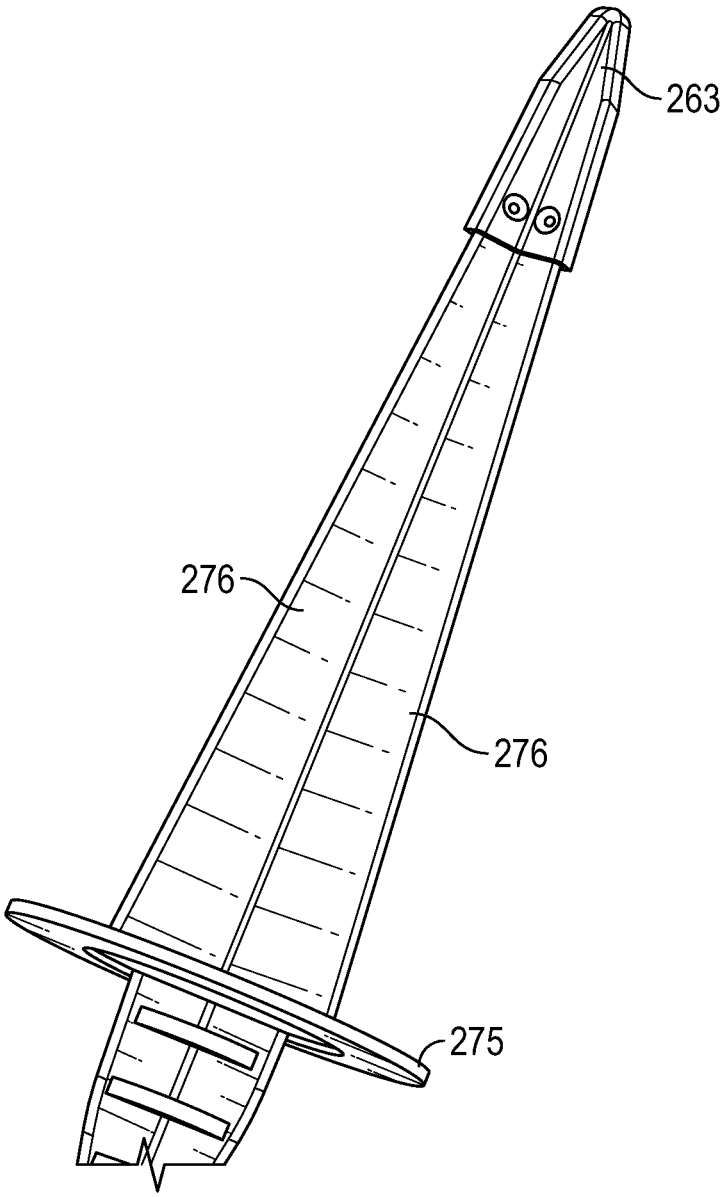
FIG. 20 is a side view showing a point of the stake of FIG. 18.
Figure 21:
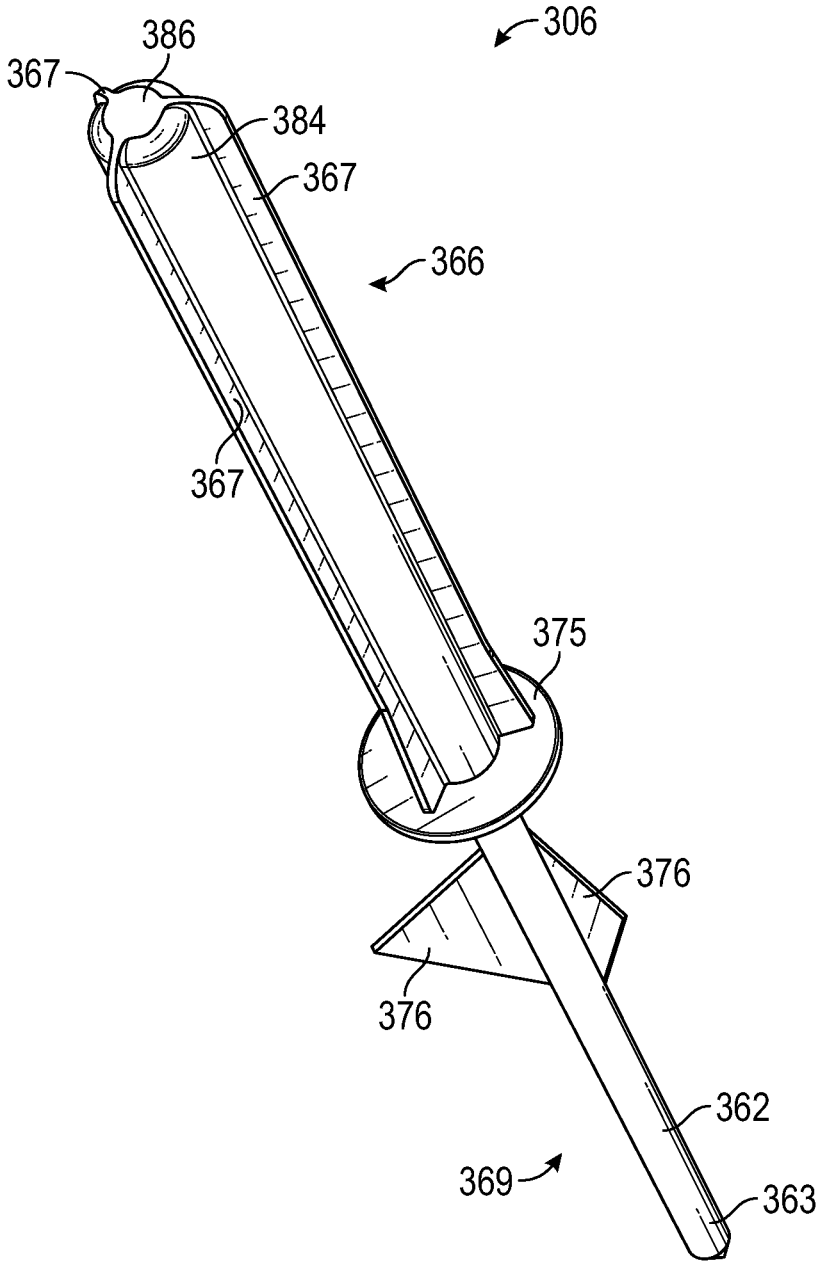
FIG. 21 is a top perspective view showing a third embodiment of a stake of the modular signage system of FIG. 1.
Figure 22:
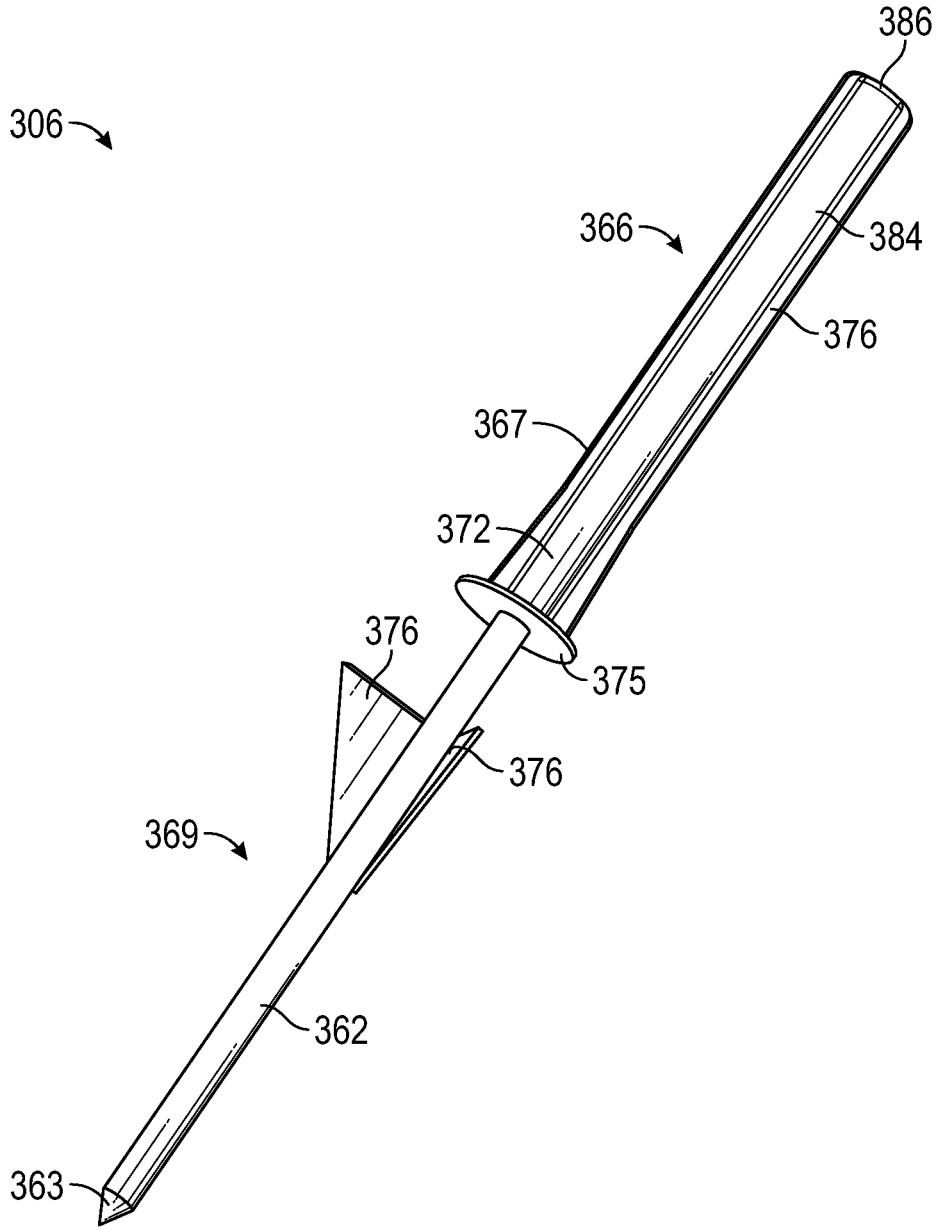
FIG. 22 is a perspective view showing the stake of FIG. 21.

Referring to FIGS. 18-20, an alternate stake 206 is illustrated having a plurality of lateral ribs 265 defined along a superior portion 268 of a stake member 262 for added structural support within the post 102. Similar to the stake 106, the stake member 262 includes a cap 266 defining an upper surface 284 that provides a hammering surface for installation of the stake 206 into the ground and provides a stable resting surface for the tab chamber 130 when assembled. Stake 206 further includes a stabilizer disc 275 at a midsection of the stake member 262 for contacting the ground during use and providing a pry surface to remove the stake 106 from the ground during disassembly. The stake member 262 continues further below the stabilizer disc 275 to define one or more stability wings 276 that collectively terminate in a point 263 configured for being driven into the ground. The superior portion 268 of the stake 206 further includes a plurality of vertical ribs 267 running from the cap 266 of the stake 206 to the stabilizer disc 275 that intersect with the lateral ribs 265 to provide additional stability to the stake member 262 when assembled within the post 102.

Figures 23A, 23B, 23C:
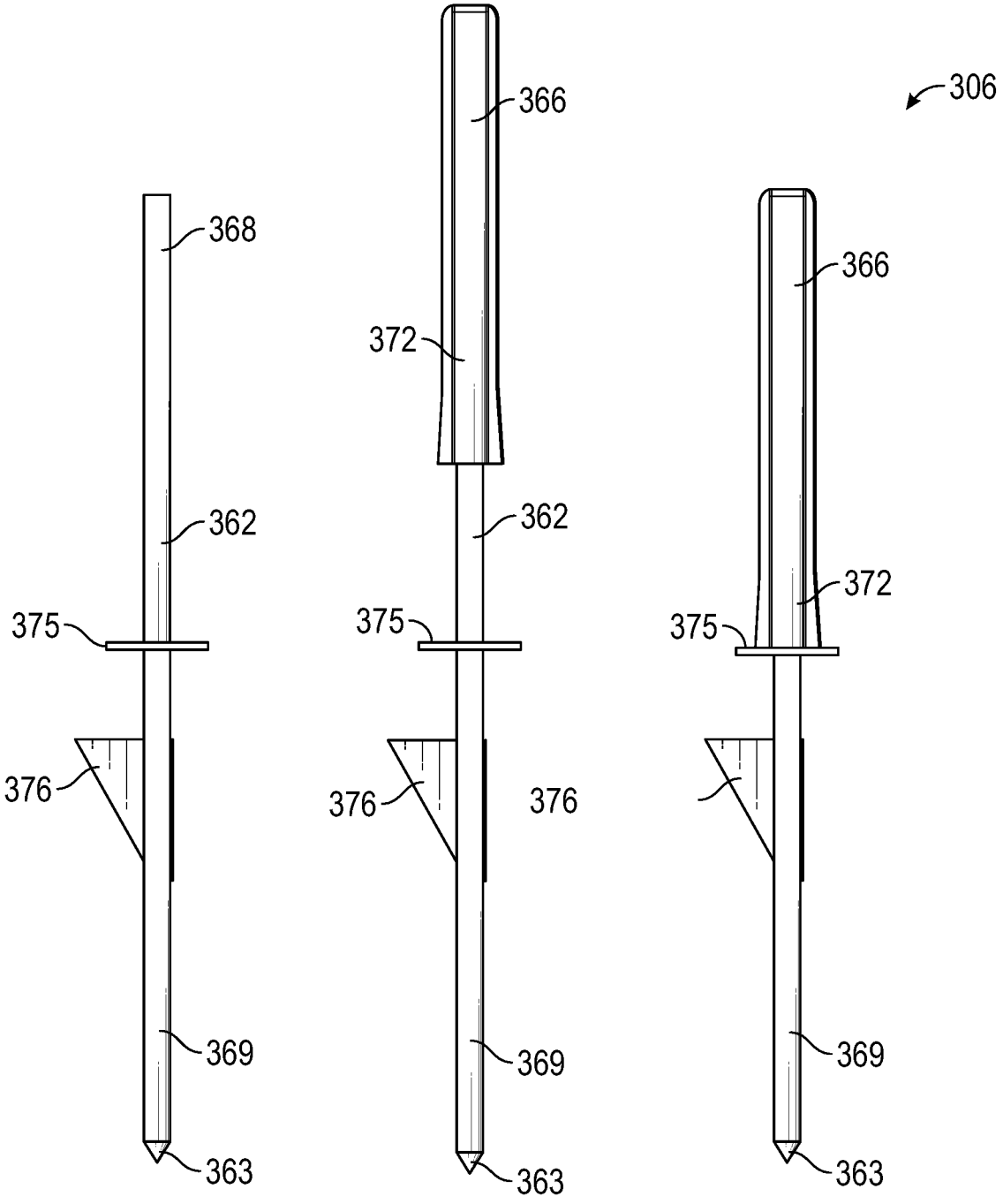
FIGS. 23A-C are sequential side views showing an engagement of a cap of the stake of FIG. 21 with a stake member.

Referring to FIGS. 21-23C, a third embodiment of a stake 306 is illustrated defining a cap 366 having a plurality of vertical ribs 367. The stake 306 includes a stake member 362 defining a superior portion 368 and an opposite inferior portion 369, the superior portion 368 configured to engage the cap 366. The inferior portion 369 defines one or more stabilizer wings 376 and terminates in a point 363 for driving into the ground surface. The stake member 362 further includes a stabilizer disc 375 at a midsection of the stake member 362 for contacting the ground during use and providing a pry surface to remove the stake 306 from the ground during disassembly. The cap 366 defines an elongated sheath 384 that includes the plurality of vertical ribs 367 running longitudinally. The cap further defines an open end 372 configured to receive the superior portion 368 of the stake member 362. As shown in FIG. 23C, when engaged with the superior portion 368 of the stake member 362, the open end 372 abuts the stabilizer disc 375. The stake 306, specifically the cap 366 and stabilizer disc 375, is then configured to engage the post 102 in a similar manner to stakes 106 and 206.

In some embodiments, components of the stake 106 (or 206 or 306) including stopper 164 as well as caps 166 are manufactured of or otherwise coated in a rubberized, shock absorbent material such as rubber or silicon. As shown in FIG. 13, in one embodiment, the height of the superior portion 268 of the stake 206 as measured from the cap 166 to the stabilizer disc 175 is 16 inches and the height of the inferior portion 269 as measured from the stabilizer disc 175 to the point 163 is 14 inches. When properly installed in the ground, the point 163 is 14 inches deep.

To install the post 102 into the ground, the stake 106 (or 206 or 306) is first driven with the point 163 into the ground. Cap 166 provides additional stability to the stake 103 within the stake cavity 107 as well as a safety measure to reduce injury when the stake 106 is implanted within the ground. Once the inferior portion 169 of the stake member 162 is sufficiently implanted within the ground up to the stabilizer disc 175, the post 102 can be installed on top of the stake 106. The inferior portion 105 of the post 102 is oriented downward and placed on top of the stake 106 such that the stake cavity 107 envelops the superior portion 168 of the stake 106.

Figure 5:
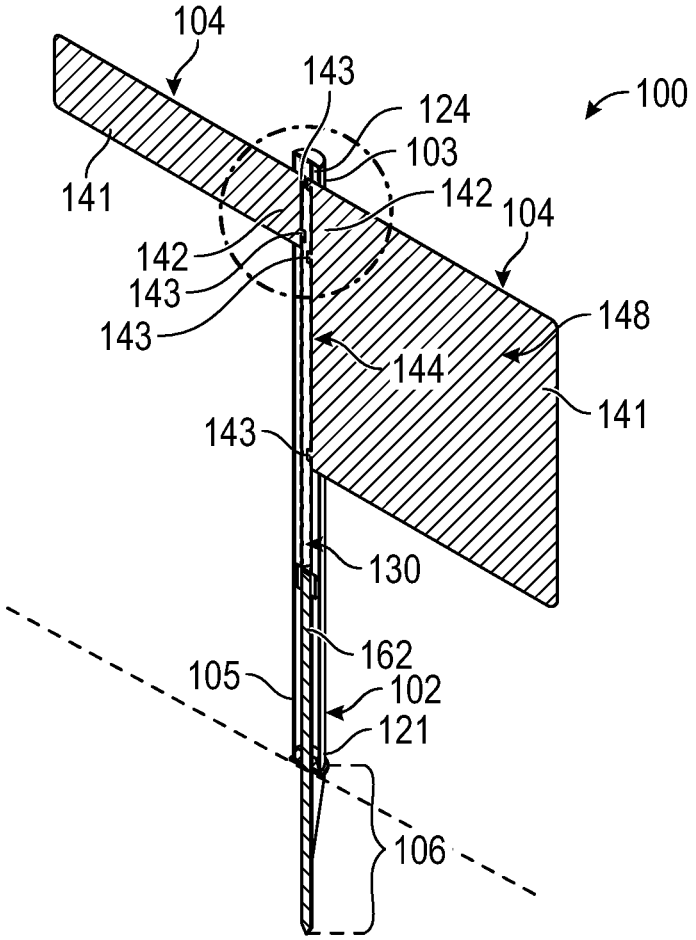
FIG. 5 is a cross-sectional perspective view showing an interior of a post of the modular signage system of FIG. 1.

As discussed above and as shown in FIGS. 1-6 and 24A-24L, each sign 104 of the one or more signs 104 forms a generally planar body 148 defining a first face 145 and an opposite second face 146. The body 148 defines the display portion 141 for displaying signage and the associated tabbed portion 142 for engaging the sign 104 to the post 102. In some embodiments, the display portion 141 occupies most of the area of the sign 104 and can be manufactured in a variety of sizes and shapes, as shown in FIGS. 21A-21L. The tabbed portion 142 is defined along a first side 144 (FIG. 5) of the display portion 141 and includes at least one tab 143. As stated above, at least one tab 143 of the tabbed portion 140 is configured for insertion within a respective tab aperture 137 of the post 102. During assembly, the sign 104 is engaged with the post 102 by insertion of the at least one tab 143 into any tab aperture 137 of the post 104 as shown in FIG. 6. FIGS. 2, 5 and 6 in particular illustrate an engagement of the tabbed portion 142 of the sign 104 with the tab chamber 130. The tabbed portion 142 is inserted into the external slot 122 of the post 102 such that each tab 143 is guided into a respective tab aperture 137 of the plurality of tab apertures 137. Each tab 143 defines a hooked distal portion 147 located at a distal end of each respective tab 143 that contacts an interior of the cavity 131 to secure the tab 143 within the tab aperture 137. In some embodiments the hooked distal portion 147 may be oriented upward or downward to prevent the tab 143 from rotating out and disengaging from the tab aperture 137.

As shown in FIGS. 24A-24L, each sign 104 can be made in various shapes and sizes, depending on the specific application of the modular signage system 100. FIGS. 21A-24L demonstrate various potential configurations of the modular signage system 100 including the various shapes of signs 104A-104J that may be engaged with the post 102; however, the number of configurations and arrangements are not limited in this regard. The configurations shown use two opposing external slots 122A and 122B of the post 102, but any number of external slots 122 of the post 102 may be used to align signs 104 at different orientations, depending on the number and orientation of walls 132 of the tab chamber 130 within the post 102.

Figures 24A, 24B, 24C:
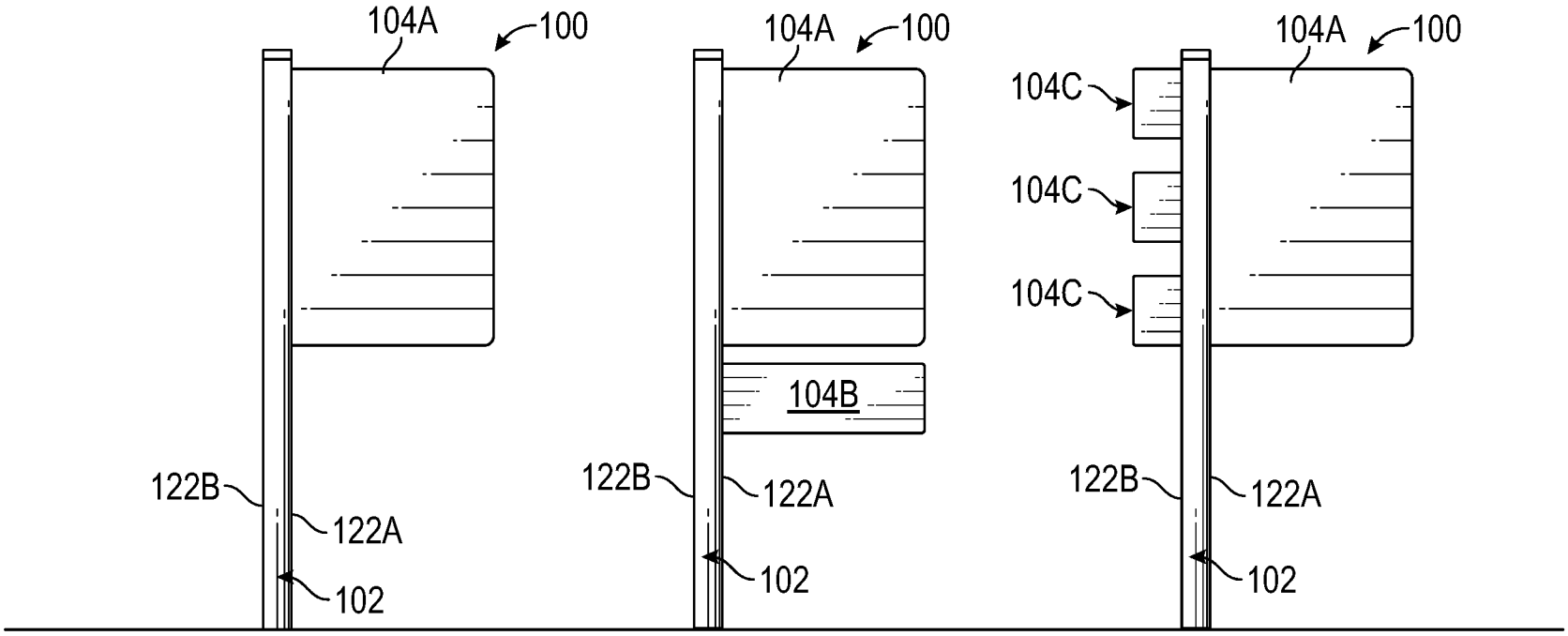
FIGS. 24A-24L are a series of front views showing various signs engaged with the post of the modular signage system of FIG. 1.

FIG. 24A illustrates a configuration of the sign 104 and post 102 having a singular large rectangular-shaped sign 104A engaged within one external slot 122A. FIG. 24B shows a second pennant-style sign 104B engaged within the external slot 122A and positioned underneath the large rectangular-shaped sign 104A. A third possible configuration is shown in FIG. 24C and includes three small signs 104C inserted into external slot 122B of the post 102 in an array oriented opposite the larger rectangular-shaped sign 104A positioned within external slot 122A.

Figures 24D, 24E, 24F, 24G:
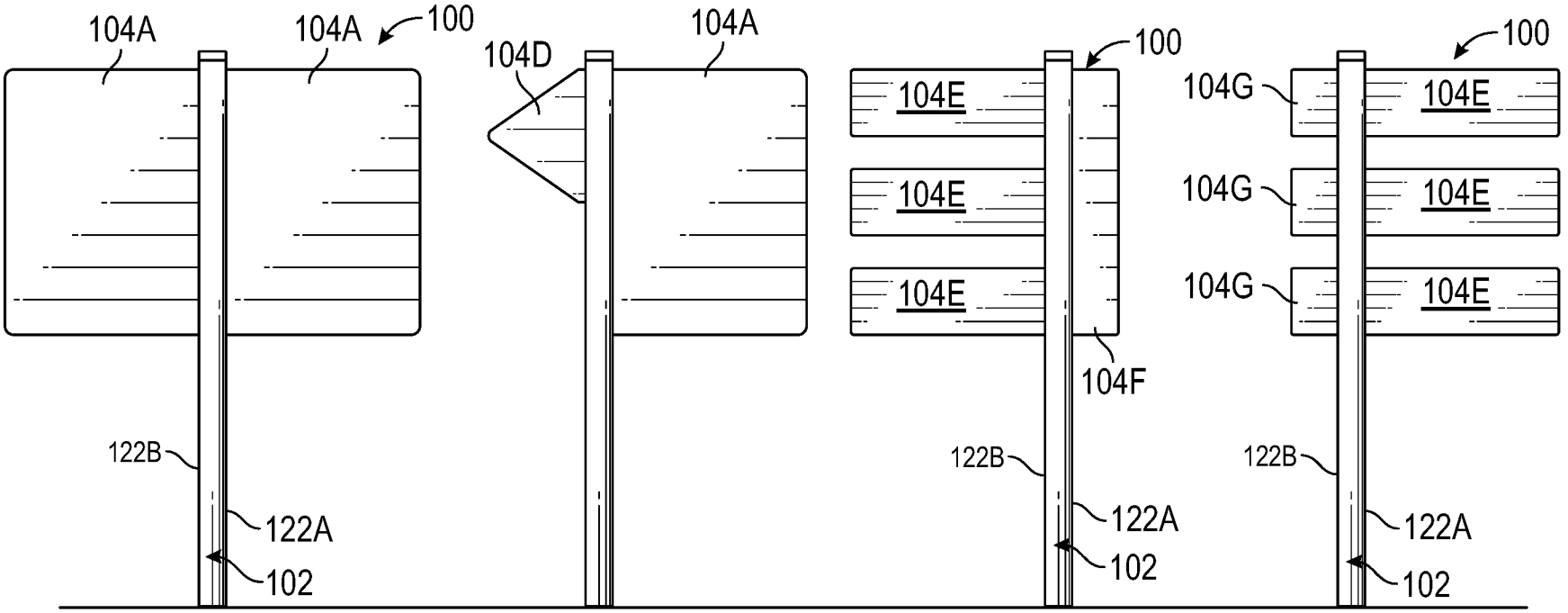

FIG. 24D shows an alternate embodiment of the modular signage system 100 featuring two of the large rectangular-shaped signs 104A inserted into respective external slots 122A and 122B, in opposite relation to each other. An embodiment of the modular signage system 100 having a small triangle-shaped sign 104D and the larger rectangular-shaped sign 104A respectively engaged with the external slot 122B and the external slot 122A is shown in FIG. 24E. FIG. 24F introduces an embodiment of the modular signage system 100 having three pennant-style signs 104B engaged in an array along the external slot 122B of the post 102 and a tall, narrow-shaped sign 104E is engaged with the external slot 122A in opposite relation to the three pennant-style signs 104B. FIG. 24G illustrates an embodiment of the modular signage system 100 showing three small signs 104C inserted into the second channel 1108 of the post 102 and three pennant-style signs 104B inserted into the first channel 110A of the post 102 in opposite relation.

Figures 24H, 24I, 24J, 24K, 24L:
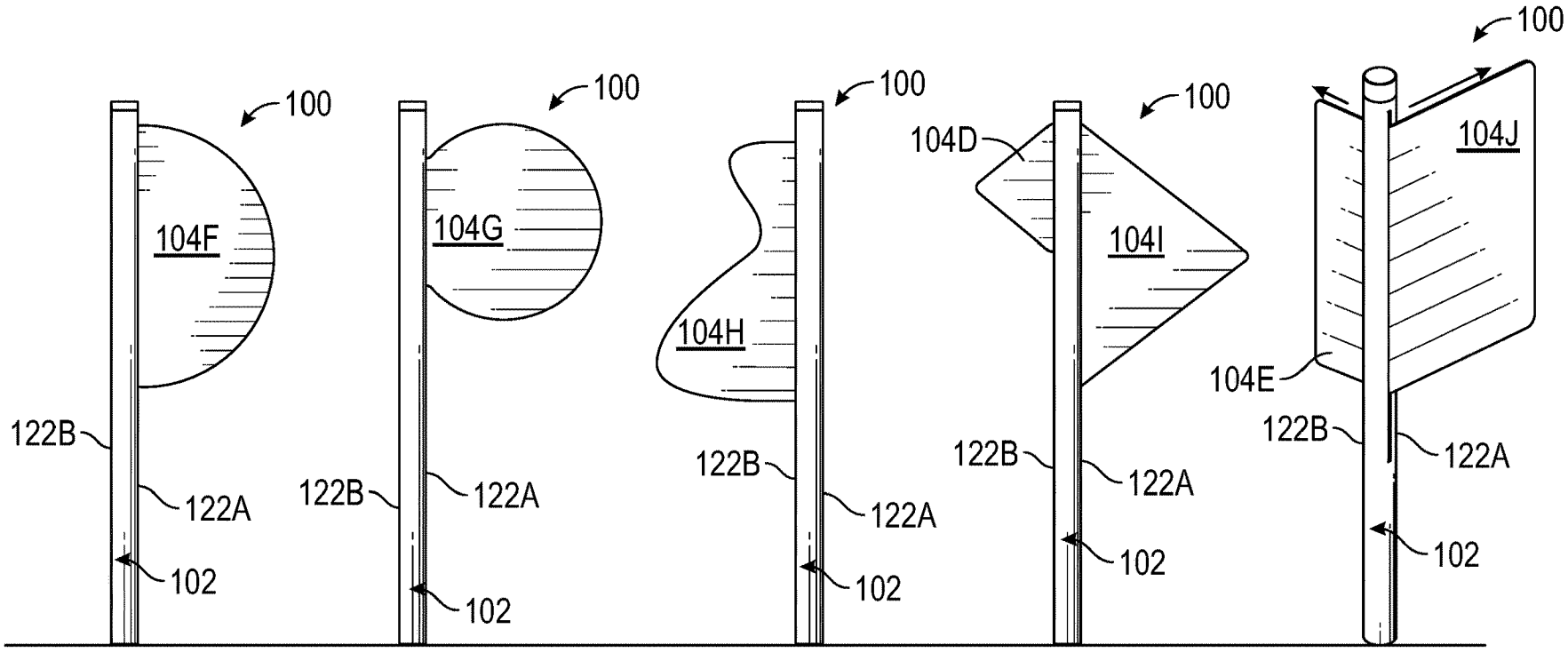

FIG. 24H shows an embodiment of the modular signage system 100 having a singular semicircular-shaped sign 104F inserted into the first channel 122A of post 102. FIG. 24I illustrates a similar arrangement using a singular circular sign 104G. FIG. 24J is an embodiment of the modular signage system 100 showing an irregularly-shaped sign 104H engaged within the external slot 122B of the post 102. FIG. 24K illustrates an embodiment of the modular signage system 100 including the small triangle-shaped sign 104D inserted into the external slot 122B of post 102 and a large triangle-shaped sign 104I inserted into the external slot 122A of post 102 in opposite relation. As shown in FIG. 24L, the sign 104J can be bent. FIG. 24L also shows the tall, narrow sign 104E engaged within the external slot 122B. Thus, various embodiments of the modular signage system 100 can be configured using a combination of signs 104 engaged to the post 102 in various arrangements and orientations.

Figure 25C:
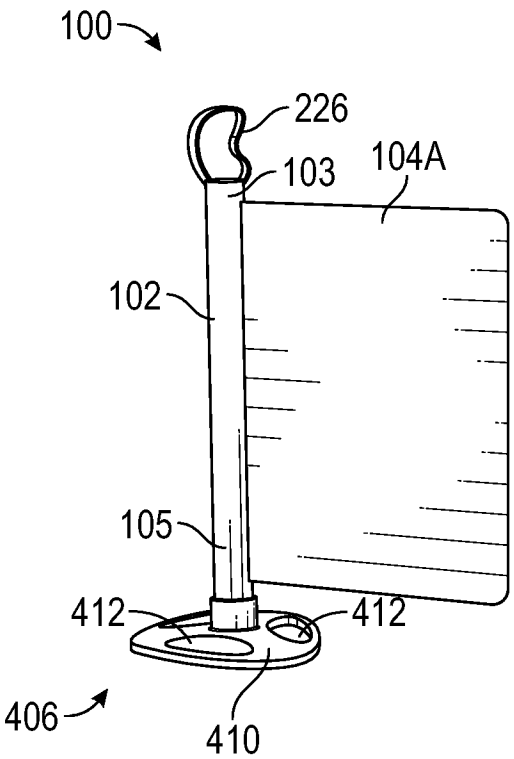
FIGS. 25A-25E are a series of views showing alternate features of the modular signage system of FIG. 1.
Figure 25B:
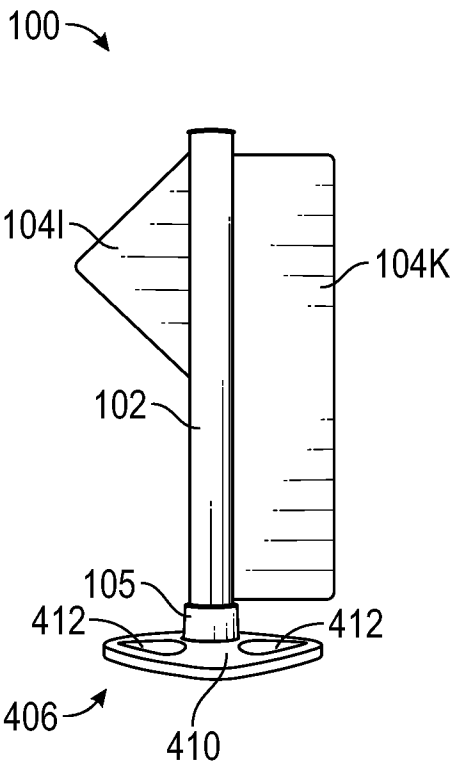
Figure 25A:
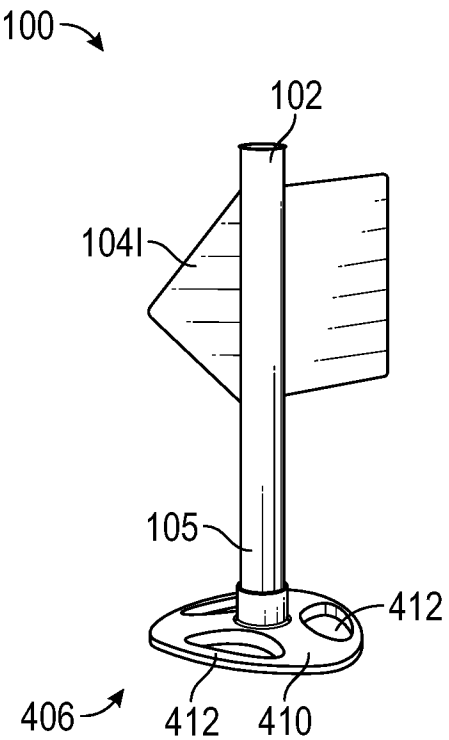
Figure 25E:
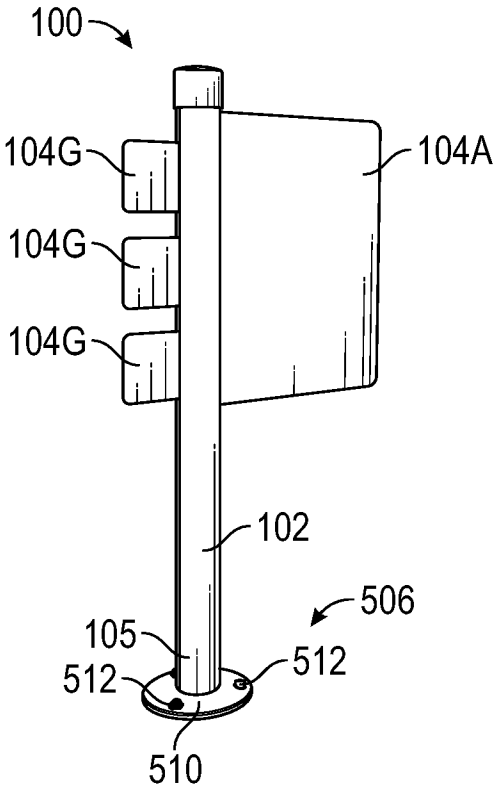
Figure 25D:
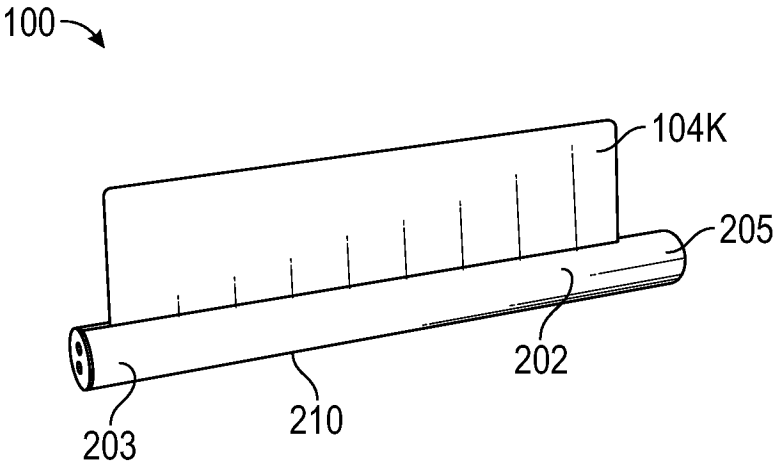

As shown in FIGS. 25A-25E, the post 102 can engage a respective stand 406 or 506 at the inferior portion 105 of the post 102, rather than the stake 106/206/306 for portable indoor or outdoor placement. In some embodiments of the stand 406 shown in FIGS. 25A-C, the stand 406 is configured to receive the inferior portion 105 of the post 102 and defines a flange body 410 configured to contact the ground and provide stabilization to the post 102. As shown, the flange body 410 can include a plurality of holes 412 for weight reduction. In another embodiment shown in FIG. 25E, an alternative stand 506 is configured to receive the inferior portion 105 of the post 102 illustrated defining a flange body 510. In some embodiments, the flange body 510 is configured to receive a plurality of bolts 512 for securing the stand 406 within a ground surface. This would be useful, in contrast to the stake 106/206/306, to allow the post 102 to be removably bolted into tile, concrete, stone, etc. for indoor or outdoor purposes. FIG. 25D illustrates an alternative arrangement of a post 202 configured to receive a sign 104 (104K in FIG. 25D) in a similar manner to that of post 102. However, the post 202 can be arranged on its side to define a first portion 203 analogous to the superior portion 103 of the post 102, and a second portion 205 analogous to the inferior portion 105 of the post 102. The post 202 can include a flat surface 210 for resting on a ground surface. In another embodiment, FIG. 25C illustrates a carrying strap 226 located at the superior portion 103 of the post. Further, in FIGS. 25B and 25D, an additional elongated sign 104K is illustrated.

Figure 26C:
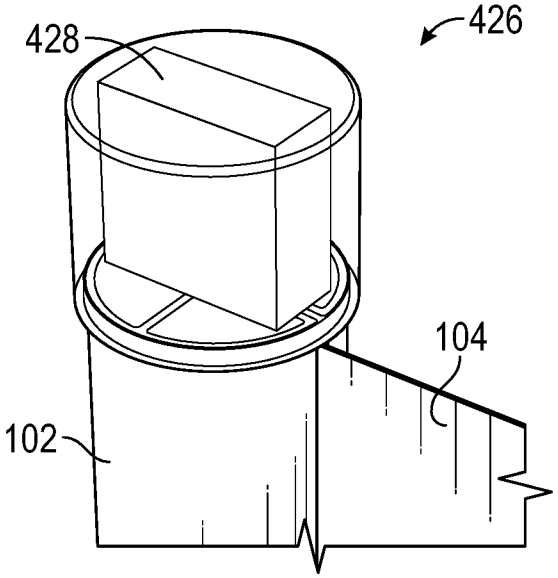
FIGS. 26A-26C are a series of views showing an electronic communication assembly of the modular signage system of FIG. 1.
Figure 26B:
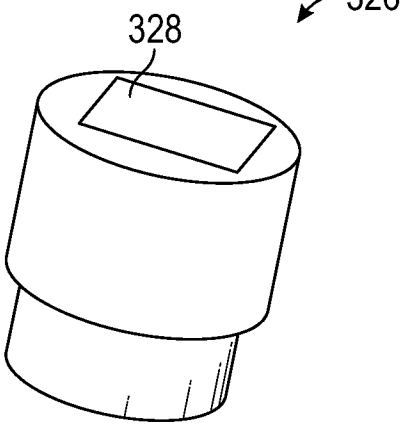
Figure 26A:
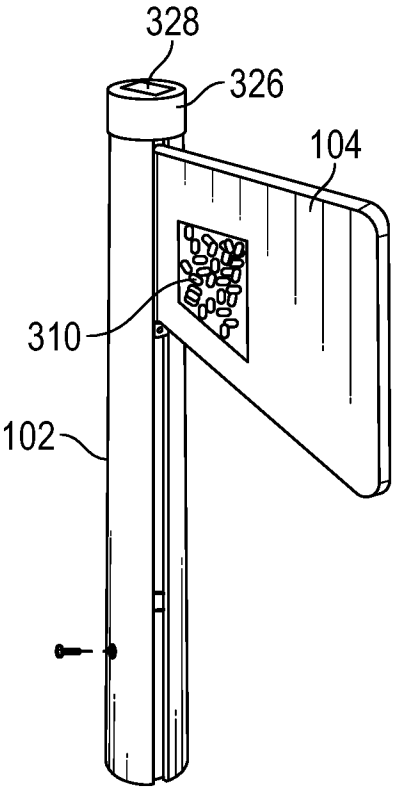

Referring to FIGS. 26A and 26B, the post 102 can include an alternative cap 326 configured to provide power and electronic communication functionality to the modular signage system 100. In particular, the cap 326 includes a photovoltaic cell 328 for powering any electronics included within the cap 326. As shown in FIG. 26A, the sign 104 can include markings such as a barcode or a QR code 310 that can link a viewer to more information through an electronic device. In some embodiments, the cap is configured to provide a "beacon" to a viewer that can electronically connect to a device and provide information to the viewer. One such cap 426 is shown in FIG. 26C, including internal electronic components 428 that are configured to connect to one or more devices within a given proximity and provide information to the viewer.

In some embodiments, during manufacture the post 102 and internal components including tab chambers 130 or 230 can be extruded from plastic or another suitable material. As discussed above, in the embodiment of the tab chamber 230, the stabilizer hooks 225 and 226 can be cut from the wall 232 of the tab chamber 230 and bent to form a 90 degree angle with the wall 232 of the tab chamber 230. In some embodiments, the sign 104 can be cut from a plastic or metal sheet. A design (not shown) can be inked, embossed, printed, or otherwise generated on the display portion 141 of the sign. The stake 106 can include metallic (such as steel) or plastic components forming the stake member 162, and can in some embodiments be at least partially coated in a rubberized material for shock absorption. As discussed, components of the stake 106 including the stopper 164 and cap 166 can be molded or otherwise manufactured from a rubberized or otherwise shock absorbent material.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A modular signage system, comprising:

a post having an elongated body defining an internal cavity, the post including:

at least one external slot defined longitudinally along the elongated body;

a tab chamber co-axially disposed within the internal cavity of the elongated body and defining at least one wall, wherein the tab chamber is in communication with the at least one external slot;

wherein the tab chamber defines at least one tab row along the at least one wall of the tab chamber;

wherein the tab row defines a plurality of tab apertures; and wherein the plurality of tab apertures is in alignment with the at least one external slot; and a sign configured to be engaged to the post, the sign having a body defining a first side having a tabbed portion including at least one tab;

wherein the tabbed portion is configured to be inserted into the external slot such that the at least one tab engages with a respective tab aperture of the plurality of tab apertures of the tab chamber; wherein the post further includes a stabilizer slot that connects the tab row of the tab chamber to the at least one external slot of the elongated body.

2. The system of claim 1, wherein the stabilizer slot is collectively formed by a pair of parallel walls that connect the at least one external slot to the wall of the tab chamber.

3. The system of claim 1, wherein the stabilizer slot is collectively formed by a row of stabilizer hooks extending from the wall of the tab chamber, wherein each stabilizer hook defines a respective curved portion extending from the tab chamber.

4. The system of claim 3, wherein each stabilizer hook is formed by perforating the wall of the tab chamber and bending a portion of material away from the wall of the tab chamber.

5. The system of claim 1, further comprising:

a stake defining a stake member configured to be engaged to and partially disposed within the post, wherein the stake member defines a superior portion configured for engagement within the post and an inferior portion configured for mounting the post.

6. The system of claim 5, further comprising:

a stake cavity defined along an inferior portion of the post, wherein the stake cavity is defined below the tab chamber and is configured to receive the superior portion of the stake.

7. The system of claim 5, wherein the stake includes a cap engaged with the superior portion of the stake member, wherein the cap is configured to abut the tab chamber when the stake is assembled within the post and wherein the cap is configured to engage the post.

8. The system of claim 7, wherein the cap defines a circumferential flange, wherein the circumferential flange is configured to contact the elongated body of the post.

9. The system of claim 7, wherein the cap defines a plurality of vertical ribs that contact the elongated body of the post around the stake member.

10. The system of claim 5, wherein the stake further includes a stabilizer disc configured to be positioned between a ground area and the elongated body of the post.

11. The system of claim 5, wherein the stake further includes a stopper configured to engage the elongated body of the post.

12. The system of claim 11, wherein the stopper defines a peripheral edge that contacts and seals the elongated body of the post around the stake member.

13. The system of claim 1, further comprising:

a stand configured to engage the inferior portion of the post, the stand defining a flange body configured to contact the ground surface and provide stabilization to the post.

14. The system of claim 1, wherein each respective tab of the least one tab includes a hooked distal portion configured to contact the tab chamber, wherein the hooked distal portion is aligned in either an upward orientation or a downward orientation.

15. A post configured for receipt of a sign, the post comprising:

an elongated body defining an internal cavity, the post including:

at least one external slot defined longitudinally along the elongated body; and a tab chamber defined within the internal cavity, wherein the tab chamber is in communication with the at least one external slot;

wherein the tab chamber defines at least one tab row along at least one wall of the tab chamber;

wherein the tab row defines a plurality of tab apertures; and wherein the plurality of tab apertures is in alignment with the external slot; and a stabilizer slot that connects the tab row of the tab chamber to the external slot of the elongated body.

16. The post of claim 15, wherein the stabilizer slot is collectively formed by a pair of parallel walls that connect the external slot to the wall of the tab chamber.

17. The post of claim 15, wherein the stabilizer slot is collectively formed by a row of stabilizer hooks extending from the wall of the tab chamber, wherein each stabilizer hook forms a respective curved portion extending from the tab chamber.

18. The post of claim 15, wherein each stabilizer hook is formed by perforating the wall of the tab chamber and bending a portion of material away from the wall of the tab chamber.

19. The post of claim 15, further comprising:

a stand configured to engage the inferior portion of the post, the stand defining a flange body configured to contact the ground surface and provide stabilization to the post.

20. The post of claim 15, wherein the tab chamber defines a generally tubular shape with a cavity defined longitudinally through the center of the tab chamber.

21. The post of claim 20, wherein each tab aperture is configured to receive a respective tab of the at least one sign such that the tab of the sign is secured within the cavity of the tab chamber.

22. A post configured for receipt of a sign, the post comprising:

an elongated body defining an internal cavity, the post including:

at least one external slot defined longitudinally along the elongated body; and a tab chamber defined within the internal cavity, wherein the tab chamber is in communication with the at least one external slot;

wherein the tab chamber defines at least one tab row along at least one wall of the tab chamber;

wherein the tab row defines a plurality of tab apertures; and wherein the plurality of tab apertures is in alignment with the external slot; and a stake cavity defined at an inferior portion of the elongated body and configured to receive a stake;

wherein the stake, when engaged within the stake cavity of the post, is configured to secure the post into the ground.

23. The post of claim 22, wherein the stake cavity is defined below the tab chamber and is configured to receive the superior portion of the stake such that the stake abuts the tab chamber when the stake is assembled within the post.

24. A method of assembly of a modular signage system, the method comprising:

providing a modular signage system, comprising:

a post defining an elongated body and an internal cavity defined interior to the elongated body, the post including:

at least one external slot defined longitudinally along the outer surface of the post; and a tab chamber defined within the internal cavity, wherein the tab chamber communicates with the at least one external slot;

wherein the tab chamber defines at least one tab row along at least one wall of the tab chamber;

wherein the tab row defines a plurality of tab apertures; and wherein the plurality of tab apertures are in alignment with the external slot;

a sign configured to be engaged to the post, the sign having a body defining a first side having a tabbed portion including at least one tab:

wherein the tabbed portion is configured to be inserted into the external slot such that the at least one tab engages with a respective tab aperture of the plurality of tab apertures of the tab chamber; and a stake defining a stake member, wherein the stake is configured to be at least partially disposed within the post, wherein the stake member defines a superior portion configured for engagement within the post and wherein the stake member defines an inferior portion configured for engagement within a surface area;

driving the stake member of the stake below the surface area such that the inferior portion of the stake is implanted below the surface area;

engaging the post to the stake such that the stake cavity of the post envelops the superior portion of the stake;

inserting the tab row of the tabbed portion of the sign into the external slot of the post such that each tab of the one or more tabs of the tabbed portion are inserted into a respective tab aperture of the plurality of tab apertures of the tab chamber and engaging a cap of the stake member with the superior portion of the stake.

* * * * *